US009236063B2

(12) United States Patent
Duni et al.

(10) Patent No.: US 9,236,063 B2
(45) Date of Patent: Jan. 12, 2016

(54) SYSTEMS, METHODS, APPARATUS, AND COMPUTER-READABLE MEDIA FOR DYNAMIC BIT ALLOCATION

(75) Inventors: Ethan Robert Duni, San Diego, CA (US); Venkatesh Krishnan, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 490 days.

(21) Appl. No.: 13/193,529

(22) Filed: Jul. 28, 2011

(65) Prior Publication Data

US 2012/0029925 A1 Feb. 2, 2012

Related U.S. Application Data

(60) Provisional application No. 61/369,662, filed on Jul. 30, 2010, provisional application No. 61/369,705, filed on Jul. 31, 2010, provisional application No. 61/369,751, filed on Aug. 1, 2010, provisional (Continued)

(51) Int. Cl.

| | |
|---|---|
| ***G10L 25/90*** | (2013.01) |
| ***G10L 19/038*** | (2013.01) |
| ***G10L 19/093*** | (2013.01) |

(52) U.S. Cl.

CPC ..... *G10L 25/90* (2013.01); *G10L 19/038* (2013.01); *G10L 19/093* (2013.01)

(58) Field of Classification Search

CPC ..... G10L 19/002; G10L 19/00; G10L 19/18; G10L 19/22; G10L 19/24; G10L 19/38; G10L 25/90; G10L 19/032; G10L 19/038; G10L 19/06; G10L 19/167; G10L 25/15

USPC ..... 704/500–502, E19.022

See application file for complete search history.

(56) References Cited

U.S. PATENT DOCUMENTS

| | | | | |
|---|---|---|---|---|
| 3,978,287 | A | 8/1976 | Fletcher et al. | |
| 4,516,258 | A * | 5/1985 | Ching et al. | 704/229 |

(Continued)

FOREIGN PATENT DOCUMENTS

| | | | |
|---|---|---|---|
| CN | 1207195 | A | 2/1999 |
| CN | 1239368 | A | 12/1999 |

(Continued)

OTHER PUBLICATIONS

Itu-T G.729.1 (May 2006), Series G: Transmission Systems and Media, Digital Systems and Networks, Digital terminal equipments—Coding of analogue signals by methods other than PCM, G.729-based embedded variable bit-rate coder: An 8-32 kbits/ scalable wideband coder bitstream interoperable with G.729, 100pp.

(Continued)

*Primary Examiner* — Eric Yen

(74) *Attorney, Agent, or Firm* — Austin Rapp & Hardman

(57) ABSTRACT

A method of bit allocation is described. The method includes, for each among a plurality of vectors, calculating a corresponding one of a plurality of gain factors. The method also includes, for each among the plurality of vectors, calculating a corresponding bit allocation that is based on the gain factor. The method further includes, for at least one among the plurality of vectors, determining that the corresponding bit allocation is not greater than a minimum allocation value. The method additionally includes, in response to the determining, for each of the at least one vector, changing the corresponding bit allocation.

31 Claims, 20 Drawing Sheets

Related U.S. Application Data application No. 61/374,565, filed on Aug. 17, 2010, provisional application No. 61/384,237, filed on Sep. 17, 2010, provisional application No. 61/470,438, filed on Mar. 31, 2011.

(56) References Cited

U.S. PATENT DOCUMENTS

| | | | | |
|---|---|---|---|---|
| 4,964,166 | A * | 10/1990 | Wilson | 704/229 |
| 5,222,146 | A | 6/1993 | Bahl et al. | |
| 5,309,232 | A | 5/1994 | Hartung et al. | |
| 5,321,793 | A | 6/1994 | Drogo De Iacovo et al. | |
| 5,388,181 | A * | 2/1995 | Anderson et al. | 704/200.1 |
| 5,479,561 | A * | 12/1995 | Kim | 704/229 |
| 5,630,011 | A | 5/1997 | Lim et al. | |
| 5,664,057 | A | 9/1997 | Crossman et al. | |
| 5,692,102 | A | 11/1997 | Pan | |
| 5,781,888 | A | 7/1998 | Herre | |
| 5,842,160 | A * | 11/1998 | Zinser | 704/229 |
| 5,911,128 | A * | 6/1999 | DeJaco | 704/200.1 |
| 5,962,102 | A | 10/1999 | Sheffield et al. | |
| 5,978,762 | A | 11/1999 | Smyth et al. | |
| 5,999,897 | A | 12/1999 | Yeldener | |
| 6,035,271 | A | 3/2000 | Chen | |
| 6,058,362 | A * | 5/2000 | Malvar | 704/230 |
| 6,064,954 | A | 5/2000 | Cohen et al. | |
| 6,078,879 | A | 6/2000 | Taori et al. | |
| 6,094,629 | A | 7/2000 | Grabb et al. | |
| 6,098,039 | A * | 8/2000 | Nishida | 704/229 |
| 6,108,623 | A | 8/2000 | Morel | |
| 6,236,960 | B1 | 5/2001 | Peng et al. | |
| 6,246,345 | B1 * | 6/2001 | Davidson et al. | 341/51 |
| 6,301,556 | B1 | 10/2001 | Hagen et al. | |
| 6,308,150 | B1 | 10/2001 | Neo et al. | |
| 6,363,338 | B1 * | 3/2002 | Ubale et al. | 704/200.1 |
| 6,424,939 | B1 | 7/2002 | Herre et al. | |
| 6,593,872 | B2 | 7/2003 | Makino et al. | |
| 6,766,288 | B1 | 7/2004 | Smith | |
| 6,952,671 | B1 | 10/2005 | Kolesnik et al. | |
| 7,069,212 | B2 * | 6/2006 | Tanaka et al. | 704/225 |
| 7,272,556 | B1 | 9/2007 | Aguilar et al. | |
| 7,310,598 | B1 * | 12/2007 | Mikhael et al. | 704/230 |
| 7,340,394 | B2 * | 3/2008 | Chen et al. | 704/230 |
| 7,493,254 | B2 | 2/2009 | Jung et al. | |
| 7,613,607 | B2 | 11/2009 | Valve et al. | |
| 7,660,712 | B2 | 2/2010 | Gao et al. | |
| 7,885,819 | B2 | 2/2011 | Koishida et al. | |
| 7,912,709 | B2 | 3/2011 | Kim | |
| 8,111,176 | B2 | 2/2012 | Tosato et al. | |
| 8,364,471 | B2 | 1/2013 | Yoon et al. | |
| 8,370,133 | B2 | 2/2013 | Taleb et al. | |
| 8,493,244 | B2 | 7/2013 | Satoh et al. | |
| 8,831,933 | B2 | 9/2014 | Duni et al. | |
| 2001/0023396 | A1 | 9/2001 | Gersho et al. | |
| 2002/0161573 | A1 | 10/2002 | Yoshida | |
| 2002/0169599 | A1 | 11/2002 | Suzuki | |
| 2003/0061055 | A1 | 3/2003 | Taori et al. | |
| 2003/0233234 | A1 | 12/2003 | Truman et al. | |
| 2004/0133424 | A1 | 7/2004 | Ealey et al. | |
| 2004/0196770 | A1 | 10/2004 | Touyama et al. | |
| 2005/0080622 | A1 | 4/2005 | Dieterich et al. | |
| 2006/0015329 | A1 | 1/2006 | Chu | |
| 2006/0036435 | A1 | 2/2006 | Kovesi et al. | |
| 2007/0271094 | A1 | 11/2007 | Ashley et al. | |
| 2007/0282603 | A1 | 12/2007 | Bessette | |
| 2007/0299658 | A1 | 12/2007 | Wang et al. | |
| 2008/0027719 | A1 | 1/2008 | Kirshnan et al. | |
| 2008/0040120 | A1 * | 2/2008 | Kurniawati et al. | 704/500 |
| 2008/0052066 | A1 | 2/2008 | Oshikiri et al. | |
| 2008/0059201 | A1 | 3/2008 | Hsiao | |
| 2008/0097757 | A1 * | 4/2008 | Vasilache | 704/229 |
| 2008/0126904 | A1 | 5/2008 | Sung et al. | |
| 2008/0234959 | A1 | 9/2008 | Joublin et al. | |
| 2008/0310328 | A1 | 12/2008 | Li et al. | |
| 2008/0312758 | A1 | 12/2008 | Koishida et al. | |
| 2008/0312759 | A1 | 12/2008 | Koishida et al. | |
| 2008/0312914 | A1 | 12/2008 | Rajendran et al. | |
| 2009/0006103 | A1 * | 1/2009 | Koishida et al. | 704/500 |
| 2009/0177466 | A1 | 7/2009 | Rui et al. | |
| 2009/0187409 | A1 | 7/2009 | Krishnan et al. | |
| 2009/0234644 | A1 | 9/2009 | Reznik et al. | |
| 2009/0271204 | A1 | 10/2009 | Tammi | |
| 2009/0299736 | A1 | 12/2009 | Sato | |
| 2009/0319261 | A1 | 12/2009 | Gupta et al. | |
| 2009/0326962 | A1 | 12/2009 | Chen et al. | |
| 2010/0017198 | A1 | 1/2010 | Yamanashi et al. | |
| 2010/0054212 | A1 | 3/2010 | Tang | |
| 2010/0121646 | A1 * | 5/2010 | Ragot et al. | 704/500 |
| 2010/0169081 | A1 | 7/2010 | Yamanashi et al. | |
| 2010/0280831 | A1 | 11/2010 | Salami et al. | |
| 2011/0173012 | A1 | 7/2011 | Rettelbach et al. | |
| 2011/0178795 | A1 | 7/2011 | Bayer et al. | |
| 2012/0029923 | A1 | 2/2012 | Rajendran et al. | |
| 2012/0029924 | A1 | 2/2012 | Duni et al. | |
| 2012/0029926 | A1 | 2/2012 | Krishnan et al. | |
| 2012/0046955 | A1 | 2/2012 | Rajendran et al. | |
| 2012/0173231 | A1 | 7/2012 | Li et al. | |
| 2012/0185256 | A1 * | 7/2012 | Virette et al. | 704/500 |
| 2013/0013321 | A1 | 1/2013 | Oh et al. | |
| 2013/0117015 | A1 | 5/2013 | Bayer et al. | |
| 2013/0144615 | A1 | 6/2013 | Rauhala et al. | |
| 2013/0218577 | A1 | 8/2013 | Taleb et al. | |

FOREIGN PATENT DOCUMENTS

| | | | |
|---|---|---|---|
| CN | 1367618 | A | 9/2002 |
| CN | 101030378 | A | 9/2007 |
| CN | 101523485 | A | 9/2009 |
| CN | 101622661 | A | 1/2010 |
| JP | 63033935 | | 2/1988 |
| JP | S6358500 | A | 3/1988 |
| JP | H01205200 | A | 8/1989 |
| JP | H07273660 | A | 10/1995 |
| JP | H09244694 | A | 9/1997 |
| JP | H09288498 | A | 11/1997 |
| JP | H1097298 | A | 4/1998 |
| JP | H11502318 | A | 2/1999 |
| JP | 11-224099 | | 8/1999 |
| JP | 2001044844 | A | 2/2001 |
| JP | 2001249698 | A | 9/2001 |
| JP | 2002542522 | A | 12/2002 |
| JP | 2004163696 | A | 6/2004 |
| JP | 2004246038 | A | 9/2004 |
| JP | 2004538525 | A | 12/2004 |
| JP | 2005527851 | A | 9/2005 |
| JP | 2006301464 | A | 11/2006 |
| JP | 2007525707 | A | 9/2007 |
| JP | 2010518422 | A | 5/2010 |
| JP | 2011527455 | A | 10/2011 |
| WO | 0063886 | A1 | 10/2000 |
| WO | WO03015077 | A1 | 2/2003 |
| WO | WO-03088212 | A1 | 10/2003 |
| WO | 03107329 | A1 | 12/2003 |
| WO | 2005078706 | A1 | 8/2005 |
| WO | 2009029036 | A1 | 3/2009 |
| WO | WO2010003565 | A1 | 1/2010 |
| WO | WO2010081892 | A2 | 7/2010 |

OTHER PUBLICATIONS

Rongshan, Yu, et al., "High Quality Audio Coding Using a Novel Hybrid WLP-Subband Coding Algorithm," Fifth International Symposium on Signal Processing and its Applications, ISSPA '99, Brisbane, AU, Aug. 22-25, 1999, pp. 483-486.

Adoul J-P, et al., "Baseband speech coding at 2400 BPS using spherical vector quantization", International Conference on Acoustics, Speech & Signal Processing. ICASSP. San Diego, Mar. 19-21, 1984; [International Conference on Acoustics, Speech & Signal Processing. ICASSP], New York, IEEE, US, vol. 1, Mar. 19, 1984, pp. 1.12/1-1.12/4, XP002301076.

Bartkowiak Maciej, et al., "Harmonic Sinusoidal + Noise Modeling of Audio Based on Multiple FO Estimation", AES Convention 125;

(56) References Cited

OTHER PUBLICATIONS

Oct. 2008, AES, 60 East 42nd Street, Room 2520 New York 10165-2520, USA, Oct. 1, 2008, XP040508748.
Bartkwiak et al.,"A unifying Approach to Transfor, and Sinusoidal Coding of Audio", AES Convention 124; May 2008, AES, 60 East 42nd Street, Room 2520 New York 10165-2520, USA, May 1, 2008, XP040508700, Section 2.2-4, Figure 3.
Chunghsin Yeh, et al., "Multiple Fundamental Frequency Estimation of Polyphonic Music Signals", 2005 IEEE International Conference on Acoustics, Speech, and Signal Processing—Mar. 18-23, 2005—Philadelphia, PA, USA, IEEE, Piscataway, NJ, vol. 3, Mar. 18, 2005, pp. 225-228, XP010792370, DOI: 10.1109/ICASSP.2005.1415687 ISBN: 978-0-7803-8874-1.
Doval B, et al., "Estimation o f fundamental frequency of musical sound signals", Speech Processing 1. Toronto, May 14-17, 1991; [International Conference on Acoustics, Speech & Signal Processing. ICASSP], New York, IEEE, US, vol. Conf. 16, Apr. 14, 1991, pp. 3657-3660, XP010043661, DOI: 10.1109/ICASSP.1991.151067 ISBN: 978-0-7803-0003-3.
International Search Report and Written Opinion—PCT/US2011/045862—ISA/EPO—Feb. 10, 2012.
Lee D H et al: "Cell-conditioned multistage vector quantization", Speech Processing 1. Toronto, May 14-17, 1991; [International Conference on Acoustics, Speech & Signal Processing.ICASSP], New York, IEEE,US, vol. Conf.16, Apr. 14, 1991, pp. 653-656, XP010043060, DOI: 10.1109/ICASSP.1991.150424 ISBN: 978-0-7803-0003-3.
Paiva Rui Pedro, et al., "A Methodology for Detection of Melody in Polyphonic Musical Signals", AES Convention 116; May 2004, AES, 60 East 42nd Street, Room 2520 New York 10165-2520, USA, May 1, 2004-, XP040506771.
3GPP TS 26.290 v8.0.0.,"Audio codec processing functions; Extended Adaptive Multi-rate—Wideband (AMR-WB+) codec; Transcoding functions", Release 8, pp. 1-87, (Dec. 2008).
3GPP2 C.S00014-D, v2.0, "Enhanced Variable Rate Codec, Speech Service Options 3, 68, 70, and 73 for Wideband Spread Spectrum Digital Systems", 3GPP2 (3rd Generation Partnership Project 2), Telecommunications Industry Association, Arlington, VA., pp. 1-308 (Jan. 25, 2010).
Cardinal, J., "A fact full search equivalent for mean-shape-gain vector quantizers," 20th Symp. on Inf. Theory in the Benelux, 1999, 8 pp.
Etemoglu, et al., "Structured Vector Quantization Using Linear Transforms," IEEE Transactions on Signal Processing, vol. 51, No. 6, Jun. 2003, pp. 1625-1631.
Matschkal, B. et al. "Joint Signal Processing for Spherical Logarithmic Quantization and DPCM," 6th Int'l ITG-Conf. on Source and Channel Coding, Apr. 2006, 6 pp.
Mehrotra S. et al., "Low Bitrate Audio Coding Using Generalized Adaptive Gain Shape Vector Quantization Across Channels", Proceeding ICASSP '09 Proceedings of the 2009 IEEE International Conference on Acoustics, Speech and Signal Processing, Apr. 2009, pp. 1-4, IEEE Computer Society.
Mittal U., et al. "Low Complexity Factorial Pulse Coding of MDCT Coefficients using Approximation of Combinatorial Functions", IEEE International Conference on Acoustics, Speech and Signal Processing, vol. 1, Apr. 15-20, 2007, pp. II-289-II-292.
Murashima, A., et al., "A post-processing technique to improve coding quality of CELP under background noise" Proc. IEEE Workshop on Speech Coding, pp. 102-104 (Sep. 2000).
Oehler, K.L. et al., "Mean-gain-shape vector quantization," ICASSP 1993, pp. V-241-V-244.
Oger, M., et al., "Transform audio coding with arithmetic-coded scalar quantization and model-based bit allocation" ICASSP, pp. IV-545-IV-548 (2007).
Oshikiri, M. et al., "Efficient Spectrum Coding for Super-Wideband Speech and Its Application to Jul. 10, 2015 KHZ Bandwidth Scalable Coders", Acoustics, Speech, and Signal Processing, 2004. Proceedings. (ICASSP '04). IEEE International Conference on, May 2004, pp. I-481-4, vol. 1.
Sampson, D., et al., "Fast lattice-based gain-shape vector quantisation for image-sequence coding," IEE Proc.-I, vol. 140, No. 1, Feb. 1993, pp. 56-66.
Terriberry, T.B. Pulse Vector Coding, 3 pp. Available online Jul. 22, 2011 at http://people.xiph.org/~tterribe/notes/cwrs.html.
Valin, J-M. et al., "A full-bandwidth audio codec with low complexity and very low delay," 5 pp. Available online Jul. 22, 2011 at http://jmvalin.ca/papers/celte_eusipco2009.pdf.
Valin, J-M. et al., "A High-Quality Speech and Audio Codec With Less Than 10 ms Delay," 10 pp., Available online Jul. 22, 2011 at http://jmvalin.ca/papers/celt tasl.pdf, (published in IEEE Transactions on Audio, Speech, and Language Processing, vol. 18, No. 1, 2010, pp. 58-67).
Allott D., et al., "Shape adaptive activity controlled multistage gain shape vector quantisation of images." Electronics Letters, vol. 21, No. 9 (1985): 393-395.
Pisczalski M., et al.,"Predicting Musical Pitch from Component Frequency Ratios", Acoustical Society of America, vol. 66, Issue 3, 1979, pp. 710-720.
Klapuri A., at el., "Multiple Fundamental Frequency Estimation by Summing Harmonic Amplitudes," in ISMIR, 2006, pp. 216-221.

* cited by examiner $$S^T \begin{bmatrix} & \\ -S[2:N] & I^{(N-1)\times(N-1)} - \frac{S[2:N]S^T[2:N]}{(1+S[1])} \end{bmatrix}$$

FIG. 20

SYSTEMS, METHODS, APPARATUS, AND COMPUTER-READABLE MEDIA FOR DYNAMIC BIT ALLOCATION

CLAIM OF PRIORITY UNDER 35 U.S.C. §119

The present Application for Patent claims priority to Provisional Application No. 61/369,662, entitled "SYSTEMS, METHODS, APPARATUS, AND COMPUTER-READABLE MEDIA FOR EFFICIENT TRANSFORM-DOMAIN CODING OF AUDIO SIGNALS," filed Jul. 30, 2010. The present Application for Patent claims priority to Provisional Application No. 61/369,705, entitled "SYSTEMS, METHODS, APPARATUS, AND COMPUTER-READABLE MEDIA FOR DYNAMIC BIT ALLOCATION," filed Jul. 31, 2010. The present Application for Patent claims priority to Provisional Application No. 61/369,751, entitled "SYSTEMS, METHODS, APPARATUS, AND COMPUTER-READABLE MEDIA FOR MULTI-STAGE SHAPE VECTOR QUANTIZATION," filed Aug. 1, 2010. The present Application for Patent claims priority to Provisional Application No. 61/374,565, entitled "SYSTEMS, METHODS, APPARATUS, AND COMPUTER-READABLE MEDIA FOR GENERALIZED AUDIO CODING," filed Aug. 17, 2010. The present Application for Patent claims priority to Provisional Application No. 61/384,237, entitled "SYSTEMS, METHODS, APPARATUS, AND COMPUTER-READABLE MEDIA FOR GENERALIZED AUDIO CODING," filed Sep. 17, 2010. The present Application for Patent claims priority to Provisional Application No. 61/470,438, entitled "SYSTEMS, METHODS, APPARATUS, AND COMPUTER-READABLE MEDIA FOR DYNAMIC BIT ALLOCATION," filed Mar. 31, 2011.

BACKGROUND

1. Field

This disclosure relates to the field of audio signal processing.

2. Background

Coding schemes based on the modified discrete cosine transform (MDCT) are typically used for coding generalized audio signals, which may include speech and/or non-speech content, such as music. Examples of existing audio codecs that use MDCT coding include MPEG-1 Audio Layer 3 (MP3), Dolby Digital (Dolby Labs., London, UK; also called AC-3 and standardized as ATSC A/52), Vorbis (Xiph.Org Foundation, Somerville, Mass.), Windows Media Audio (WMA, Microsoft Corp., Redmond, Wash.), Adaptive Transform Acoustic Coding (ATRAC, Sony Corp., Tokyo, JP), and Advanced Audio Coding (AAC, as standardized most recently in ISO/IEC 14496-3:2009). MDCT coding is also a component of some telecommunications standards, such as Enhanced Variable Rate Codec (EVRC, as standardized in 3$^{rd}$ Generation Partnership Project 2 (3GPP2) document C.S0014-D v2.0, Jan. 25, 2010). The G.718 codec ("Frame error robust narrowband and wideband embedded variable bit-rate coding of speech and audio from 8-32 kbit/s," Telecommunication Standardization Sector (ITU-T), Geneva, CH, June 2008, corrected November 2008 and August 2009, amended March 2009 and March 2010) is one example of a multi-layer codec that uses MDCT coding.

SUMMARY

A method of bit allocation according to a general configuration includes, for each among a plurality of vectors, calculating a corresponding one of a plurality of gain factors. This method also includes, for each among the plurality of vectors, calculating a corresponding bit allocation that is based on the gain factor. This method also includes, for at least one among the plurality of vectors, determining that the corresponding bit allocation is not greater than a minimum allocation value. This method also includes changing the corresponding bit allocation, in response to said determining, for each of said at least one vector. Computer-readable storage media (e.g., non-transitory media) having tangible features that cause a machine reading the features to perform such a method are also disclosed.

An apparatus for bit allocation according to a general configuration includes means for calculating, for each among a plurality of vectors, a corresponding one of a plurality of gain factors, and means for calculating, for each among the plurality of vectors, a corresponding bit allocation that is based on the gain factor. This apparatus also includes means for determining, for at least one among the plurality of vectors, that the corresponding bit allocation is not greater than a minimum allocation value and means for changing the corresponding bit allocation, in response to said determining, for each of said at least one vector.

An apparatus for bit allocation according to another general configuration includes a gain factor calculator configured to calculate, for each among a plurality of vectors, a corresponding one of a plurality of gain factors, and a bit allocation calculator configured to calculate, for each among the plurality of vectors, a corresponding bit allocation that is based on the gain factor. This apparatus also includes a comparator configured to determine, for at least one among the plurality of vectors, that the corresponding bit allocation is not greater than a minimum allocation value, and an allocation adjustment module configured to change the corresponding bit allocation, in response to said determining, for each of said at least one vector.

BRIEF DESCRIPTION OF THE DRAWINGS

FIG. 20 shows an example of a rotation matrix.

DETAILED DESCRIPTION

Figure 1A:
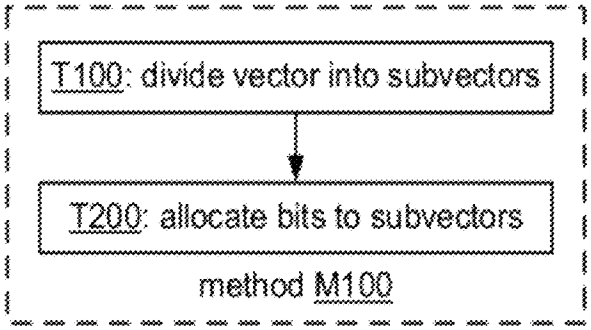
FIG. 1A shows a flowchart for a method M100 according to a general configuration.

It may be desirable to use a dynamic bit allocation scheme that is based on coded gain parameters which are known to both the encoder and the decoder, such that the scheme may be performed without the explicit transmission of side information from the encoder to the decoder.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. A "task" having multiple subtasks is also a method. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The systems, methods, and apparatus described herein are generally applicable to coding representations of audio signals in a frequency domain. A typical example of such a representation is a series of transform coefficients in a transform domain. Examples of suitable transforms include discrete orthogonal transforms, such as sinusoidal unitary transforms. Examples of suitable sinusoidal unitary transforms include the discrete trigonometric transforms, which include without limitation discrete cosine transforms (DCTs), discrete sine transforms (DSTs), and the discrete Fourier transform (DFT). Other examples of suitable transforms include lapped versions of such transforms. A particular example of a suitable transform is the modified DCT (MDCT) introduced above.

Reference is made throughout this disclosure to a "lowband" and a "highband" (equivalently, "upper band") of an audio frequency range, and to the particular example of a lowband of zero to four kilohertz (kHz) and a highband of 3.5 to seven kHz. It is expressly noted that the principles discussed herein are not limited to this particular example in any way, unless such a limit is explicitly stated. Other examples (again without limitation) of frequency ranges to which the application of these principles of encoding, decoding, allocation, quantization, and/or other processing is expressly contemplated and hereby disclosed include a lowband having a lower bound at any of 0, 25, 50, 100, 150, and 200 Hz and an upper bound at any of 3000, 3500, 4000, and 4500 Hz, and a highband having a lower bound at any of 3000, 3500, 4000, 4500, and 5000 Hz and an upper bound at any of 6000, 6500, 7000, 7500, 8000, 8500, and 9000 Hz. The application of such principles (again without limitation) to a highband having a lower bound at any of 3000, 3500, 4000, 4500, 5000, 5500, 6000, 6500, 7000, 7500, 8000, 8500, and 9000 Hz and an upper bound at any of 10, 10.5, 11, 11.5, 12, 12.5, 13, 13.5, 14, 14.5, 15, 15.5, and 16 kHz is also expressly contemplated and hereby disclosed. It is also expressly noted that although a highband signal will typically be converted to a lower sampling rate at an earlier stage of the coding process (e.g., via resampling and/or decimation), it remains a highband signal and the information it carries continues to represent the highband audio-frequency range.

A coding scheme that includes dynamic bit allocation as described herein may be applied to code any audio signal (e.g., including speech). Alternatively, it may be desirable to use such a coding scheme only for non-speech audio (e.g., music). In such case, the coding scheme may be used with a classification scheme to determine the type of content of each frame of the audio signal and select a suitable coding scheme.

A coding scheme that includes dynamic bit allocation as described herein may be used as a primary codec or as a layer or stage in a multi-layer or multi-stage codec. In one such example, such a coding scheme is used to code a portion of the frequency content of an audio signal (e.g., a lowband or a highband), and another coding scheme is used to code another portion of the frequency content of the signal. In another such example, such a coding scheme is used to code a residual (i.e., an error between the original and encoded signals) of another coding layer.

Low-bit-rate coding of audio signals often demands an optimal utilization of the bits available to code the contents of the audio signal frame. The contents of the audio signal frames may be either the PCM (pulse-code modulation) samples of the signal or a transform-domain representation of the signal. Encoding of each frame typically includes dividing the frame into a plurality of subbands (i.e., dividing the frame as a vector into a plurality of subvectors), assigning a bit allocation to each subvector, and encoding each subvector into the corresponding allocated number of bits. It may be desirable in a typical audio coding application, for example, to perform vector quantization on a large number of (e.g., ten, twenty, thirty, or forty) different subband vectors for each frame. Examples of frame size include (without limitation) 100, 120, 140, 160, and 180 values (e.g., transform coefficients), and examples of subband length include (without limitation) five, six, seven, eight, nine, ten, eleven, twelve, and sixteen.

One approach to bit allocation is to split up a total bit allocation uniformly among the subvectors. For example, the number of bits allocated to each subvector may be fixed from frame to frame. In this case, the decoder may already be configured with knowledge of the bit allocation scheme, such that there is no need for the encoder to transmit this information. However, the goal of the optimum utilization of bits may be to ensure that various components of the audio signal frame are coded with a number of bits that is related (e.g., proportional) to their perceptual significance. Some of the input subband vectors may be less significant (e.g., may capture little energy), such that a better result might be obtained by allocating fewer bits to encode these vectors and more bits to encode the vectors of more important subbands.

As a fixed allocation scheme does not account for variations in the relative perceptual significance of the subvectors, it may be desirable to use a dynamic allocation scheme instead, such that the number of bits allocated to each subvector may vary from frame to frame. In this case, information regarding the particular bit allocation scheme used for each frame is supplied to the decoder so that the frame may be decoded.

Most audio encoders explicitly provide such bit allocation information to the decoder as side information. Audio coding algorithms such as AAC, for example, typically use side information or entropy coding schemes such as Huffman coding to convey the bit allocation information. Use of information solely to convey bit allocation is inefficient, as this side information is not used directly for coding the signal. While variable-length codewords like Huffman coding or arithmetic coding may provide some advantage, one may encounter long codewords that may reduce coding efficiency.

It may be desirable instead to use a dynamic bit allocation scheme that is based on coded gain parameters which are known to both the encoder and the decoder, such that the scheme may be performed without the explicit transmission of side information from the encoder to the decoder. Such efficiency may be especially important for low-bit-rate applications, such as cellular telephony. In one example, such a dynamic bit allocation may be implemented without side information by allocating bits for shape vector quantization according to the values of the associated gains.

FIG. 1A shows a flowchart of a method M100 according to a general configuration that includes a division task T100 and a bit allocation task T200. Task T100 receives a vector that is to be encoded (e.g., a plurality of transform domain coefficients of a frame) and divides it into a set of subvectors. The subvectors may but need not overlap and may even be separated from one another (in the particular examples described herein, the subvectors do not overlap). This division may be predetermined (e.g., independent of the contents of the vector), such that each input vector is divided the same way. One example of a predetermined division divides each 100-element input vector into three subvectors of respective lengths (25, 35, 40). Another example of a predetermined division divides an input vector of 140 elements into a set of twenty subvectors of length seven. A further example of a predetermined division divides an input vector of 280 elements into a set of forty subvectors of length seven.

Figure 2:
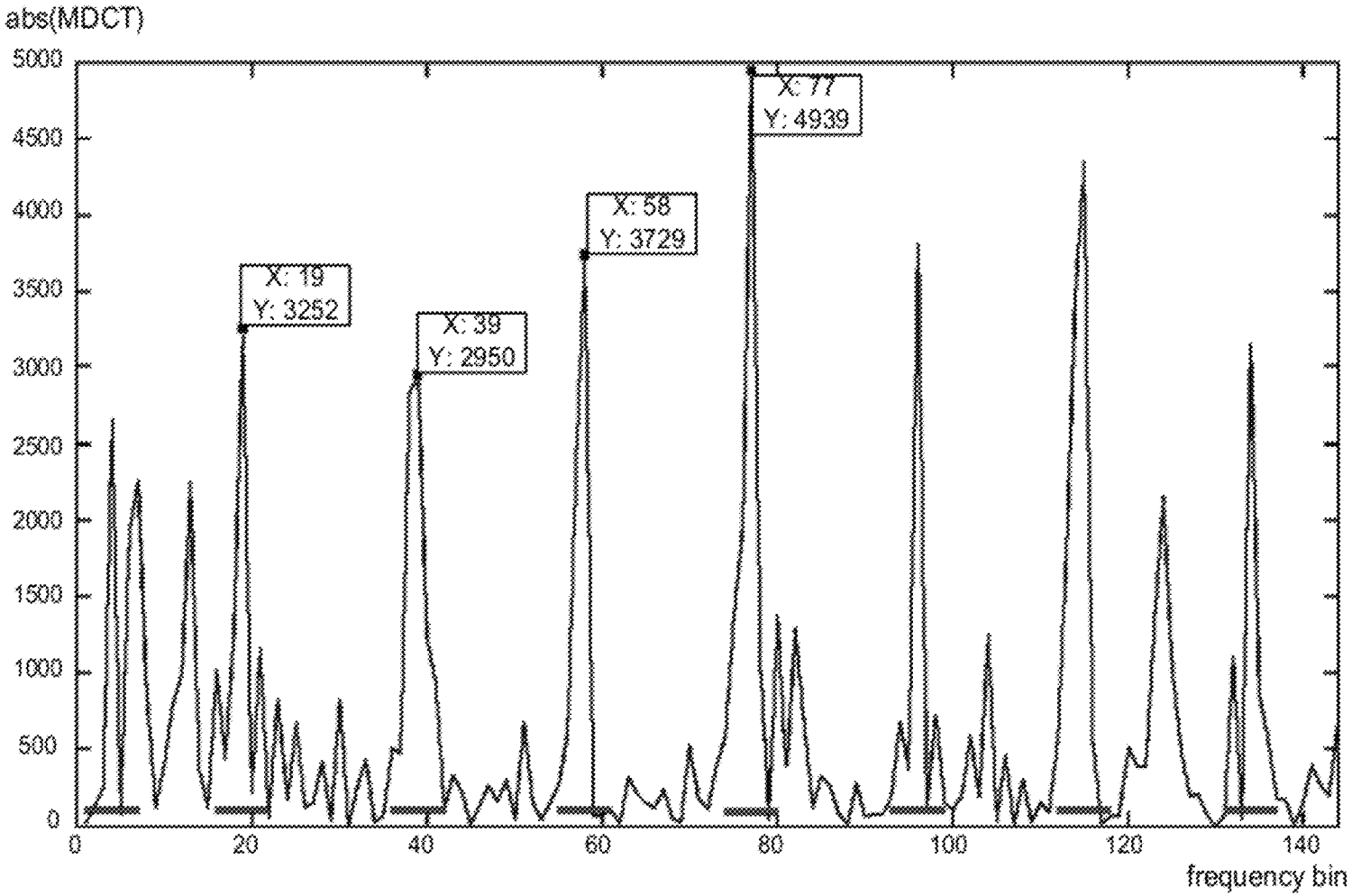
FIG. 2 shows an example of selected subbands in a low-band audio signal.
Figure 3:
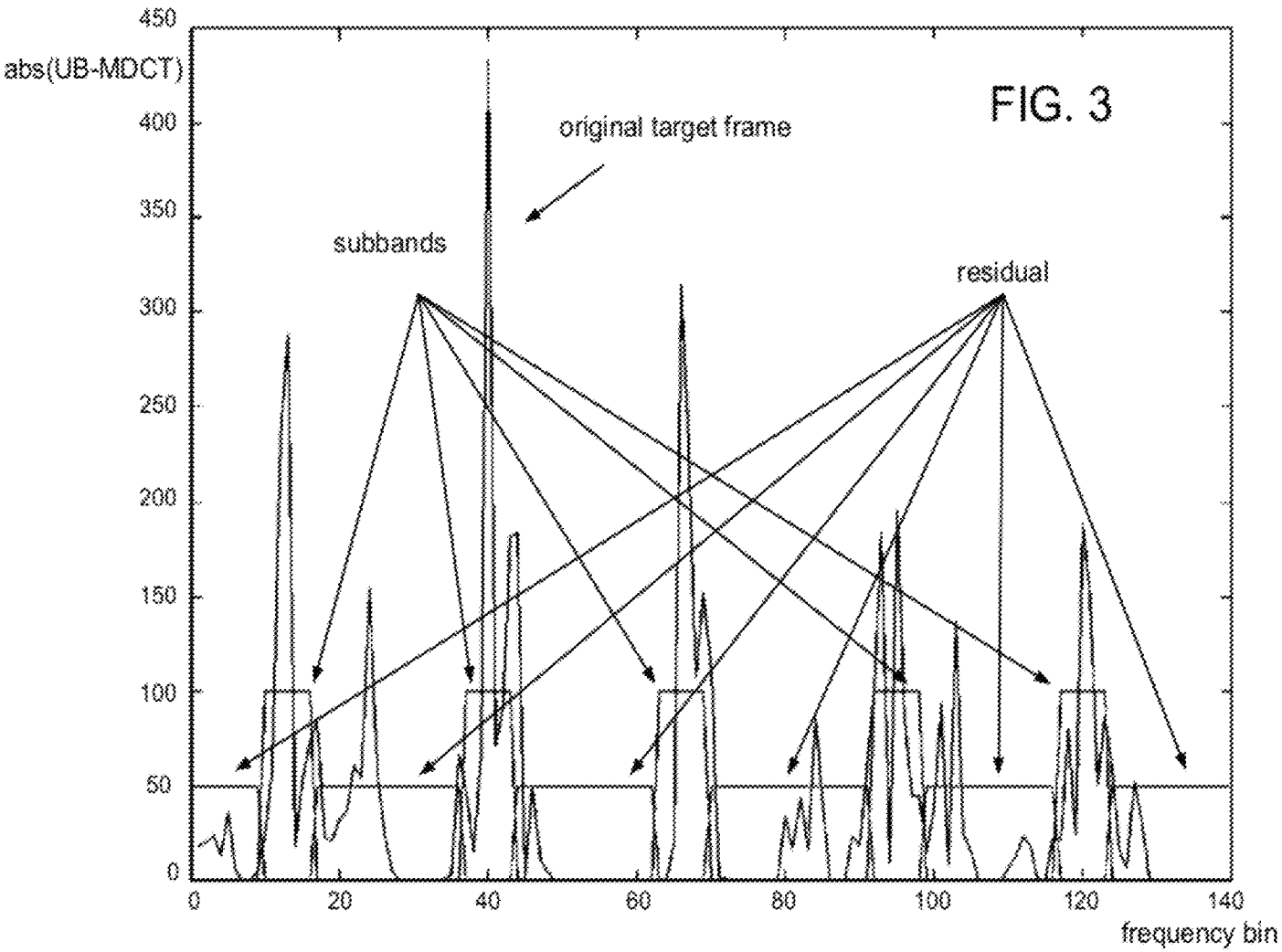
FIG. 3 shows an example of selected subbands and residual components in a highband audio signal.

Alternatively, this division may be variable, such that the input vectors are divided differently from one frame to the next (e.g., according to some perceptual criteria). It may be desirable, for example, to perform efficient transform domain coding of an audio signal by detection and targeted coding of harmonic components of the signal. FIG. 2 shows a plot of magnitude vs. frequency in which eight selected subbands of length seven that correspond to harmonically spaced peaks of a lowband linear prediction coding (LPC) residual signal are indicated by bars near the frequency axis. FIG. 3 shows a similar example for a highband LPC residual signal that indicates the residual components that lie between and outside of the selected subbands. In such case, it may be desirable to perform a dynamic allocation between the set of subbands and the entire residual, to perform a dynamic allocation among the set of subbands, and/or to perform a dynamic allocation among the residual components. Additional description of harmonic modeling and harmonic-mode coding may be found in the applications listed above to which this application claims priority.

Figure 4A:
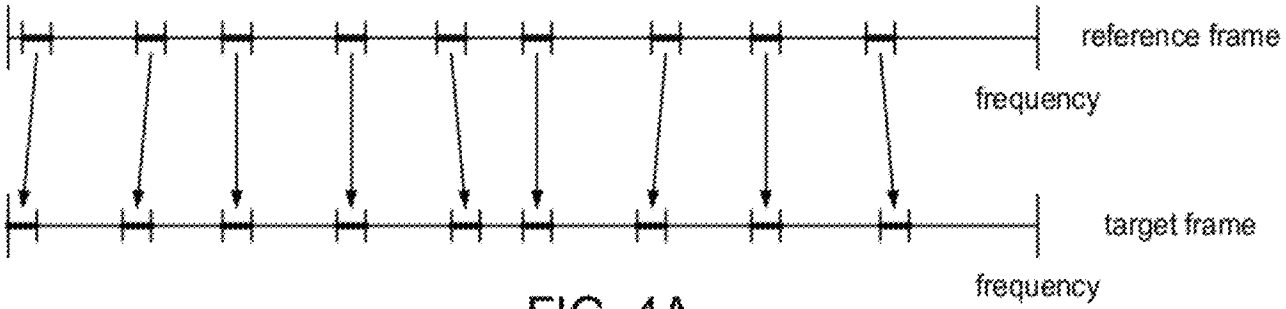
FIG. 4A shows an example of a relation between subband locations in a reference frame and a target frame.

Another example of a variable division scheme identifies a set of perceptually important subbands in the current frame (also called the target frame) based on the locations of perceptually important subbands in a coded version of another frame (also called the reference frame), which may be the previous frame. FIG. 4A shows an example of a subband selection operation in such a coding scheme (also called dependent-mode coding). Additional description of dependent-mode coding may be found in the applications listed above to which this application claims priority.

Another example of a residual signal is obtained by coding a set of selected subbands and subtracting the coded set from the original signal. In this case, it may be desirable to divide the resulting residual into a set of subvectors (e.g., according to a predetermined division) and perform a dynamic allocation among the subvectors.

The selected subbands may be coded using a vector quantization scheme (e.g., a gain-shape vector quantization scheme), and the residual signal may be coded using a factorial pulse coding (FPC) scheme or a combinatorial pulse coding scheme.

From a total number of bits to be allocated among the plurality of vectors, task T200 assigns a bit allocation to each of the various vectors. This allocation may be dynamic, such that the number of bits allocated to each vector may change from frame to frame.

Method M100 may be arranged to pass the bit allocations produced by task T200 to an operation that encodes the subvectors for storage or transmission. One type of such an operation is a vector quantization (VQ) scheme, which encodes a vector by matching it to an entry in each of one or more codebooks (which are also known to the decoder) and using the index or indices of these entries to represent the vector. The length of a codebook index, which determines the maximum number of entries in the codebook, may be any arbitrary integer that is deemed suitable for the application. An implementation of method M100 as performed at a decoder may be arranged to pass the bit allocations produced by task T200 to an operation that decodes the subvectors for reproduction of an encoded audio signal.

For a case in which two or more of the plurality of vectors have different lengths, task T200 may be implemented to calculate the bit allocation for each vector m (where m=1, 2, . . . , M) based on the number of dimensions (i.e., the length) of the vector. In this case, task T200 may be configured to calculate the bit allocation $B_m$ for each vector m as $B\times(D_m/D_h)$, where B is the total number of bits to be allocated, $D_m$ is the dimension of vector m, and $D_h$ is the sum of the dimensions of all of the vectors. In some cases, task T100 may be implemented to determine the dimensions of the vectors by determining a location for each of a set of subbands, based on a set of model parameters. For harmonic-mode coding, the model parameters may include a fundamental frequency F0 (within the current frame or within another band of the frame) and a harmonic spacing d between adjacent subband peaks. Parameters for a harmonic model may also include a corresponding jitter value for each of one or more of the subbands. For dependent-mode coding, the model parameters may include a jitter value, relative to the location of a corresponding significant band of a previous coded frame, for each of one or more of the subbands. The locations and dimensions of the residual components of the frame may then be determined based on the subband locations. The residual components, which may include portions of the spectrum that are between and/or outside the subbands, may also be concatenated into one or more larger vectors.

Figure 1B:
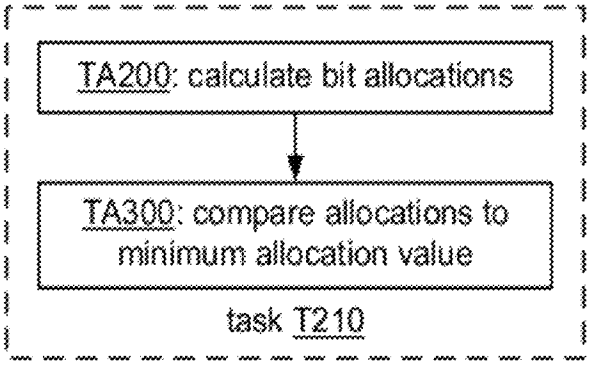
FIG. 1B shows a flowchart for an implementation T210 of task T200.

FIG. 1B shows a flowchart of an implementation T210 of dynamic bit allocation task T200 that includes subtasks TA200 and TA300. Task TA200 calculates bit allocations for the vectors, and task TA300 compares the allocations to a minimum allocation value. Task TA300 may be implemented to compare each allocation to the same minimum allocation value. Alternatively, task TA300 may be implemented to compare each allocation to a minimum allocation value that may be different for two or more among the plurality of vectors.

Task TA300 may be implemented to increase a bit allocation that is less than the minimum allocation value (for example, by changing the allocation to the minimum allocation value). Alternatively, task TA300 may be implemented to reduce a bit allocation that is less than (alternatively, not greater than) the minimum allocation value to zero.

Figure 1C:
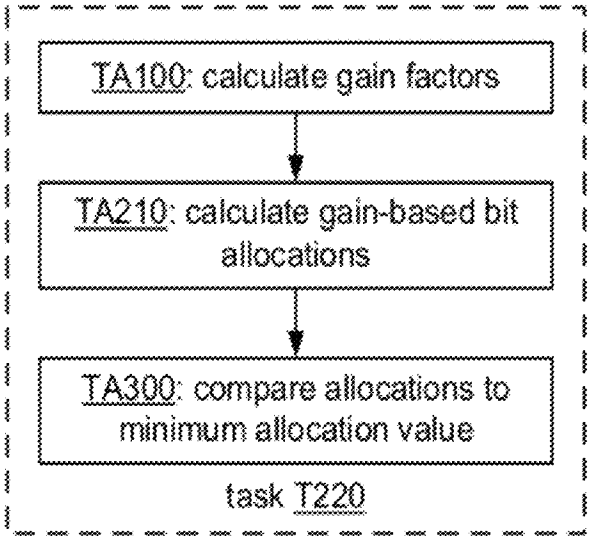
FIG. 1C shows a flowchart for an implementation T220 of task T210.

FIG. 1C shows a flowchart of an implementation T220 of dynamic bit allocation task T200 that includes subtask TA100 and an implementation TA210 of allocation task TA200. Task TA100 calculates a corresponding gain factor for each of the plurality of vectors, and task TA210 calculates a bit allocation for each vector based on the corresponding gain factor. It is typically desirable for the encoder to calculate the bit allocations using the same gain factors as the decoder. For example, it may be desirable for gain factor calculation task TA100 as performed at the decoder to produce the same result as task TA100 as performed at the encoder. Consequently, it may be desirable for task TA100 as performed at the encoder to include dequantizing the gain factors.

Gain-shape vector quantization is a coding technique that may be used to efficiently encode signal vectors (e.g., representing sound or image data) by decoupling the vector energy, which is represented by a gain factor, from the vector direction, which is represented by a shape. Such a technique may be especially suitable for applications in which the dynamic range of the signal may be large, such as coding of audio signals such as speech and/or music.

Figure 5A:
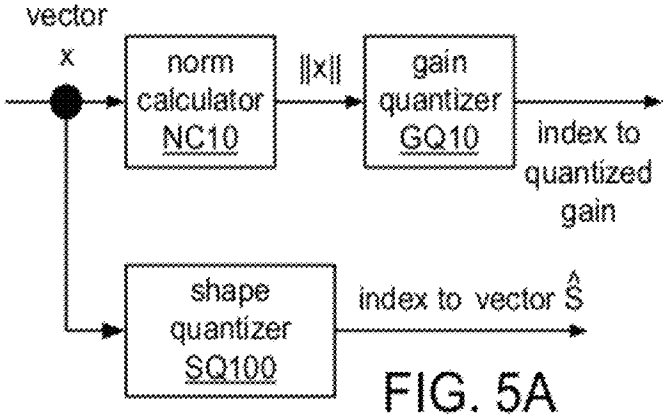
FIGS. 5A-5D show examples of gain-shape vector quantization structures.

A gain-shape vector quantizer (GSVQ) encodes the shape and gain of an input vector x separately. FIG. 5A shows an example of a gain-shape vector quantization operation. In this example, shape quantizer SQ100 is configured to perform a vector quantization (VQ) scheme by selecting the quantized shape vector $\hat{S}$ from a codebook as the closest vector in the codebook to input vector x (e.g., closest in a mean-square-error sense) and outputting the index to vector $\hat{S}$ in the codebook. In another example, shape quantizer SQ100 is configured to perform a pulse-coding quantization scheme by selecting a unit-norm pattern of unit pulses that is closest to input vector x (e.g., closest in a mean-square-error sense) and outputting a codebook index to that pattern. Norm calculator NC10 is configured to calculate the norm $\|x\|$ of input vector x, and gain quantizer GQ10 is configured to quantize the norm to produce a quantized gain factor. Gain quantizer GQ10 may be configured to quantize the norm as a scalar or to combine the norm with other gains (e.g., norms from others of the plurality of vectors) into a gain vector for vector quantization.

Shape quantizer SQ100 is typically implemented as a vector quantizer with the constraint that the codebook vectors have unit norm (i.e., are all points on the unit hypersphere). This constraint simplifies the codebook search (e.g., from a mean-squared error calculation to an inner product operation). For example, shape quantizer SQ100 may be configured to select vector $\hat{S}$ from among a codebook of K unit-norm vectors $S_k$, k=0, 1, . . . , K−1, according to an operation such as $\arg\max_k (x^T S_k)$. Such a search may be exhaustive or optimized. For example, the vectors may be arranged within the codebook to support a particular search strategy.

Figure 5B:
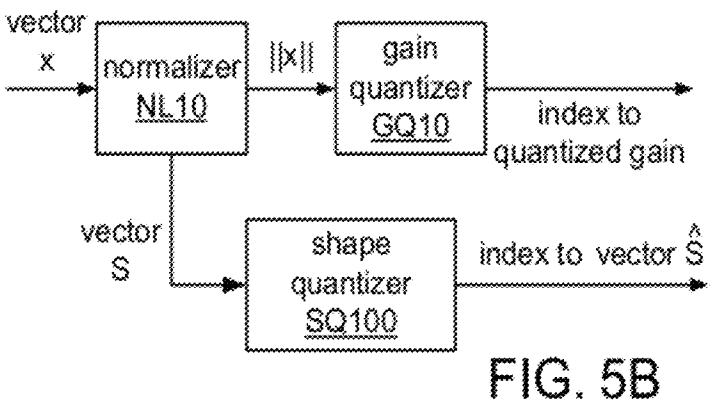

In some cases, it may be desirable to constrain the input to shape quantizer SQ100 to be unit-norm (e.g., to enable a particular codebook search strategy). FIG. 5B shows such an example of a gain-shape vector quantization operation. In this example, normalizer NL10 is configured to normalize input vector x to produce vector norm $\|x\|$ and a unit-norm shape vector $S=x/\|x\|$, and shape quantizer SQ100 is arranged to receive shape vector S as its input. In such case, shape quantizer SQ100 may be configured to select vector $\hat{S}$ from among a codebook of K unit-norm vectors $S_k$, k=0, 1, . . . , K−1, according to an operation such as $\arg\max_k (S^T S_k)$.

Alternatively, shape quantizer SQ100 may be configured to select vector $\hat{S}$ from among a codebook of patterns of unit pulses. In this case, quantizer SQ100 may be configured to select the pattern that, when normalized, is closest to shape vector S (e.g., closest in a mean-square-error sense). Such a pattern is typically encoded as a codebook index that indicates the number of pulses and the sign for each occupied position in the pattern. Selecting the pattern may include scaling the input vector and matching it to the pattern, and quantized vector $\hat{S}$ is generated by normalizing the selected pattern. Examples of pulse coding schemes that may be performed by shape quantizer SQ100 to encode such patterns include factorial pulse coding and combinatorial pulse coding.

Figure 5C:
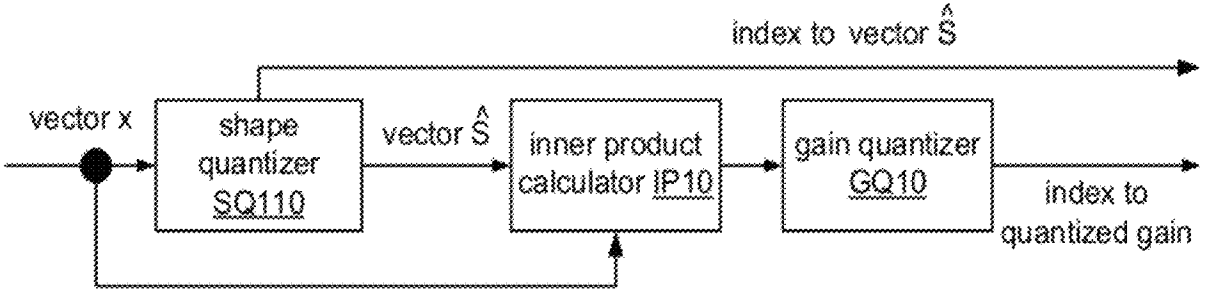
Figure 5D:
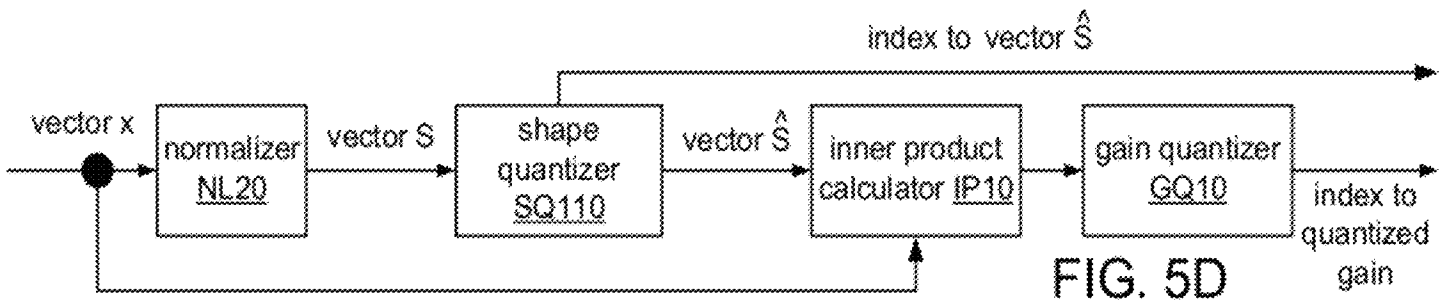

Gain quantizer GQ10 may be configured to perform scalar quantization of the gain or to combine the gain with other gains into a gain vector for vector quantization. In the example of FIGS. 5A and 5B, gain quantizer GQ10 is arranged to receive and quantize the gain of input vector x as the norm $\|x\|$ (also called the "open-loop gain"). In other cases, the gain is based on a correlation of the quantized shape vector $\hat{S}$ with the original shape. Such a gain is called a "closed-loop gain." FIG. 5C shows an example of such a gain-shape vector quantization operation that includes an inner product calculator IP10 and an implementation SQ110 of shape quantizer SQ100 that also produces the quantized shape vector $\hat{S}$. Calculator IP10 is arranged to calculate the inner product of the quantized shape vector $\hat{S}$ and the original input vector (e.g., $\hat{S}^T x$), and gain quantizer GQ10 is arranged to receive and quantize this product as the closed-loop gain. To the extent that shape quantizer SQ110 produces a poor shape quantization result, the closed-loop gain will be lower. To the extent that the shape quantizer accurately quantizes the shape, the closed-loop gain will be higher. When the shape quantization is perfect, the closed-loop gain is equal to the open-loop gain. FIG. 5D shows an example of a similar gain-shape vector quantization operation that includes a normalizer NL20 configured to normalize input vector x to produce a unit-norm shape vector $S=x/\|x\|$ as input to shape quantizer SQ110.

In a source-coding sense, the closed-loop gain may be considered to be more optimal, because it takes into account the particular shape quantization error, unlike the open-loop gain. However, it may be desirable to perform processing upstream based on this gain value. Specifically, it may be desirable to use this gain factor to decide how to quantize the shape (e.g., to dynamically allocate bits among the shapes). Such dependence of the shape coding operation on the gain may make it desirable to use an open-loop gain calculation (e.g., to avoid side information). In this case, because the gain controls the bit allocation, the shape quantization explicitly depends on the gain at both the encoder and decoder, such that a shape-independent open-loop gain calculation is used. Additional description of gain-shape vector quantization, including multistage shape quantization structures that may be used in conjunction with a dynamic allocation scheme as described herein, may be found in the applications listed above to which this application claims priority.

It may be desirable to combine a predictive gain coding structure (e.g., a differential pulse-code modulation scheme) with a transform structure for gain coding. In one such example, a vector of subband gains in one plane (e.g., a vector of the gain factors of the plurality of vectors) is inputted to the transform coder to obtain the average and the differential components, with the predictive coding operation being performed only on the average component (e.g., from frame to frame). In one such example, each element m of the length-M input gain vector is calculated according to an expression such as $10 \log_{10}\|x_m\|^2$, where $x_m$ denotes the corresponding subband vector. It may be desirable to use such a method in conjunction with a dynamic allocation task T210 as described herein. Because the average component does not affect the dynamic allocation among the vectors, the differential components (which are coded without dependence on the past) may be used as the gain factors in an implementation of dynamic allocation task T210 to obtain an operation that is resistant to a failure of the predictive coding operation (e.g., resulting from an erasure of the previous frame). FIG. 20 shows one example of a rotation matrix (where S is the column vector $[1\ 1\ 1 \ldots 1]^T/\mathrm{sqrt}(M)$ ) that may be applied by the transform coder to the length-M vector of gain factors to obtain a rotated vector having an average component in the first element and corresponding differential components in the other elements. In this case, the differential component for the element occupied by the average component may be reconstructed from the average component and the other differential components.

Task TA210 may be configured to calculate a bit allocation $B_m$ for each vector m such that the allocation is based on the number of dimensions $D_m$ and the energy $E_m$ of the vector (e.g., on the energy per dimension of the vector). In one such example, the bit allocation $B_m$ for each vector m is initialized to the value $B\times(D_m/D_h)+a \log_2 (E_m/D_m)-bF_z$, where $F_z$ is calculated as the sum $\Sigma[(D_m/D_h)\times\log_2 (E_m/D_m)]$ over all vectors m. Example values for each of the factors a and b include 0.5. For a case in which the vectors m are unit-norm vectors (e.g., shape vectors), the energy $E_m$ of each vector in task TA210 is the corresponding gain factor.

Figure 1D:
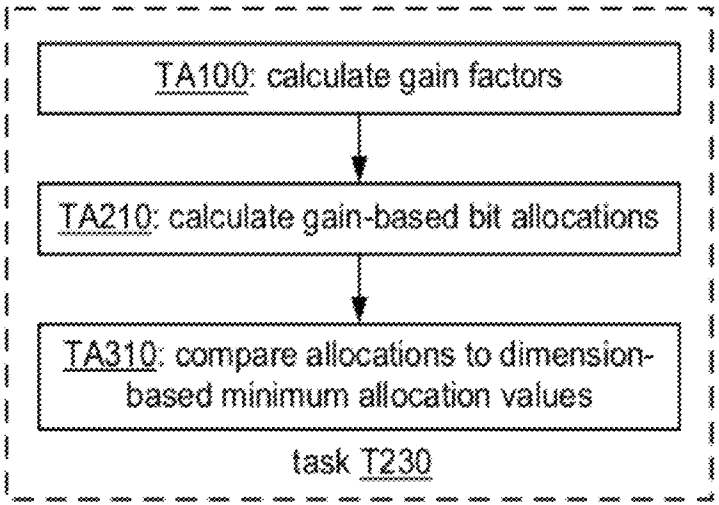
FIG. 1D shows a flowchart for an implementation T230 of task T220.

FIG. 1D shows a flowchart for an implementation T230 of dynamic allocation task T200 that includes an implementation TA310 of comparison task TA300. Task TA310 compares the current allocation for each vector m to a threshold $T_m$ that is based on the number of dimensions $D_m$ of the vector. For each vector m, the threshold $T_m$ is calculated as a monotonically nondecreasing function of the corresponding number of dimensions $D_m$. Threshold $T_m$ may be calculated, for example, as the minimum of $D_m$ and a value V. In one such example, the value of $D_m$ ranges from five to thirty-two, and the value of V is twelve. In this case, a five-dimensional vector will fail the comparison if its current allocation is less than five bits, while a twenty-four-dimensional vector will pass the comparison so long as its current allocation is at least twelve bits.

Figure 4B:
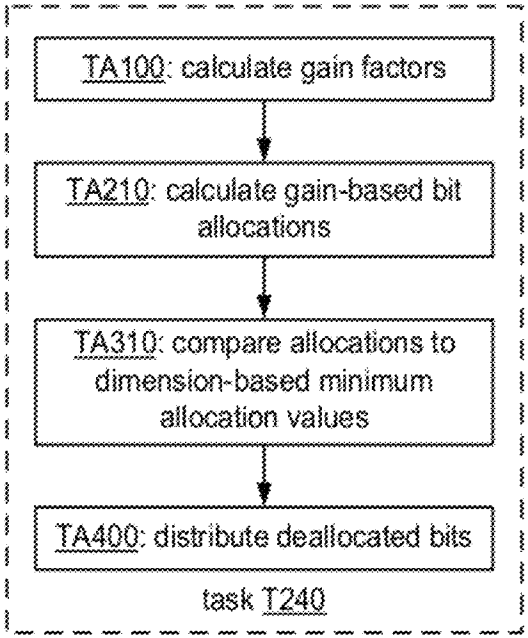
FIG. 4B shows a flowchart for an implementation T240 of task T230.

Task T230 may be configured such that the allocations for vectors which fail the comparison in task TA310 are reset to zero. In this case, the bits that were previously allocated to these vectors may be used to increase the allocations for one or more other vectors. FIG. 4B shows a flowchart for an implementation T240 of task T230 which includes a subtask TA400 that performs such a distribution (e.g., by repeating task TA210, according to a revised number of the bits available for allocation, for those vectors whose allocations are still subject to change).

It is noted in particular that although task TA210 may be implemented to perform a dynamic allocation based on perceptual criteria (e.g., energy per dimension), the corresponding implementation of method M100 may be configured to produce a result that depends only on the input gain values and vector dimensions. Consequently, a decoder having knowledge of the same dequantized gain values and vector dimensions may perform method M100 to obtain the same bit allocations without the need for a corresponding encoder to transmit any side information.

It may be desirable to configure dynamic bit allocation task T200 to impose a maximum value on the bit allocations calculated by task TA200 (e.g., task TA210). FIG. 6A shows a flowchart of such an implementation T250 of task T230 that includes an implementation TA305 of subtask TA300 which compares the bit allocations calculated in task TA210 to a maximum allocation value and/or a minimum allocation value. Task TA305 may be implemented to compare each allocation to the same maximum allocation value. Alternatively, task TA305 may be implemented to compare each allocation to a maximum allocation value that may be different for two or more among the plurality of vectors.

Task TA305 may be configured to correct an allocation that exceeds a maximum allocation value $B_{max}$ (also called an upper cap) by changing the vector's bit allocation to the value $B_{max}$ and removing the vector from active allocation (e.g., preventing further changes to the allocation for that vector). Alternatively or additionally, task TA305 may be configured to reduce a bit allocation that is less than (alternatively, not greater than) a minimum allocation value $B_{min}$ (also called a lower cap) to zero, or to correct an allocation that is less than the value $B_{min}$ by changing the vector's bit allocation to the value $B_{min}$ and removing the vector from active allocation (e.g., preventing further changes to the allocation for that vector). For vectors that are to be pulse-coded, it may be desirable to use values of $B_{min}$ and/or $B_{max}$ that correspond to integer numbers of pulses, or to skip task TA305 for such vectors.

Task TA305 may be configured to iteratively correct the worst current over- and/or under-allocations until no cap violations remain. Task TA305 may be implemented to perform additional operations after correcting all cap violations: for example, to update the values of $D_h$ and $F_z$, calculate a number of available bits $B_{av}$ that accounts for the corrective reallocations, and recalculate the allocations $B_m$ for vectors m currently in active allocation (e.g., according to an expression such as $D_m \times (B_{av}/D_h) + a \log_2(E_m/D_m) - bF_z$).

Figure 6B:
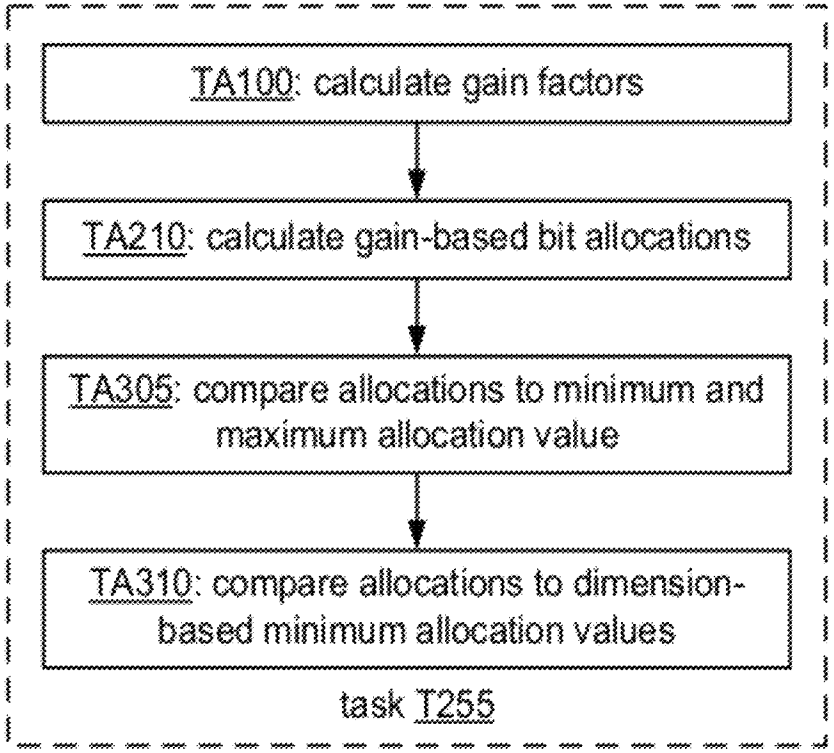
FIG. 6B shows a flowchart for an implementation T255 of task T250.
Figure 6A:
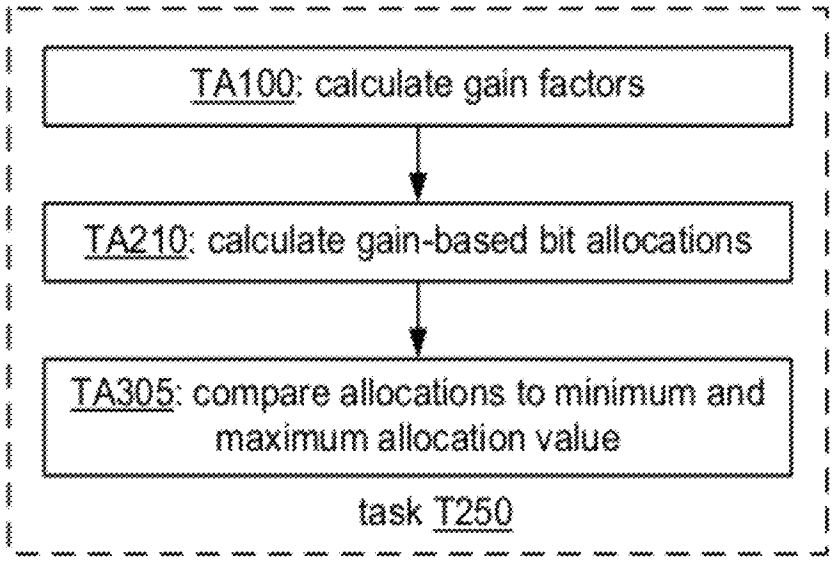
FIG. 6A shows a flowchart for an implementation T250 of task T230.

FIG. 6B shows a flowchart for an implementation T255 of dynamic allocation task T250 that also includes an instance of task TA310.

Figure 7A:
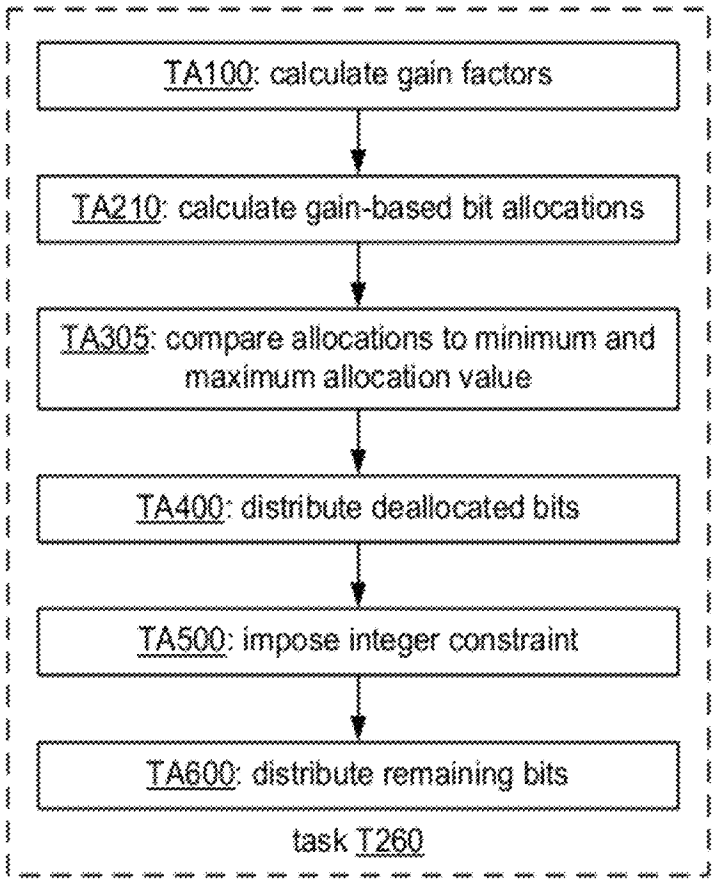
FIG. 7A shows a flowchart of an implementation T260 of task T250.

It may be desirable to configure dynamic allocation task T200 to impose an integer constraint on each of the bit allocations. FIG. 7A shows a flowchart of such an implementation T260 of task T250 that includes an instance of task TA400 and subtasks TA500 and TA600.

After the deallocated bits are distributed in task TA400, task TA500 imposes an integer constraint on the bit allocations $B_m$ by truncating each allocation $B_m$ to the largest integer not greater than $B_m$. For vectors that are to be pulse-coded, it may be desirable to truncate the corresponding allocation $B_m$ to the largest integer not greater than $B_m$ that corresponds to an integer number of pulses. Task TA500 also updates the number of available bits $B_{av}$ (e.g., according to an expression such as $B - \Sigma_{m=1}^{M} B_m$). Task TA500 may also be configured to store the truncated residue for each vector (e.g., for later use in task TA600). In one such example, task TA500 stores the truncated residue for each vector in a corresponding element of an error array ΔB.

Task TA600 distributes any bits remaining to be allocated. In one example, if the number of remaining bits $B_{av}$ is at least equal to the number of vectors currently in active allocation, task TA600 increments the allocation for each vector, removing vectors whose allocations reach $B_{max}$ from active allocation and updating $B_{av}$, until this condition no longer holds. If $B_{av}$ is less than the number of vectors currently in active allocation, task TA600 distributes the remaining bits to the vectors having the greatest truncated residues from task TA500 (e.g., the vectors that correspond to the highest values in error array ΔB). For vectors that are to be pulse-coded, it may be desirable to increase their allocations only to values that correspond to integer numbers of pulses.

Figure 7B:
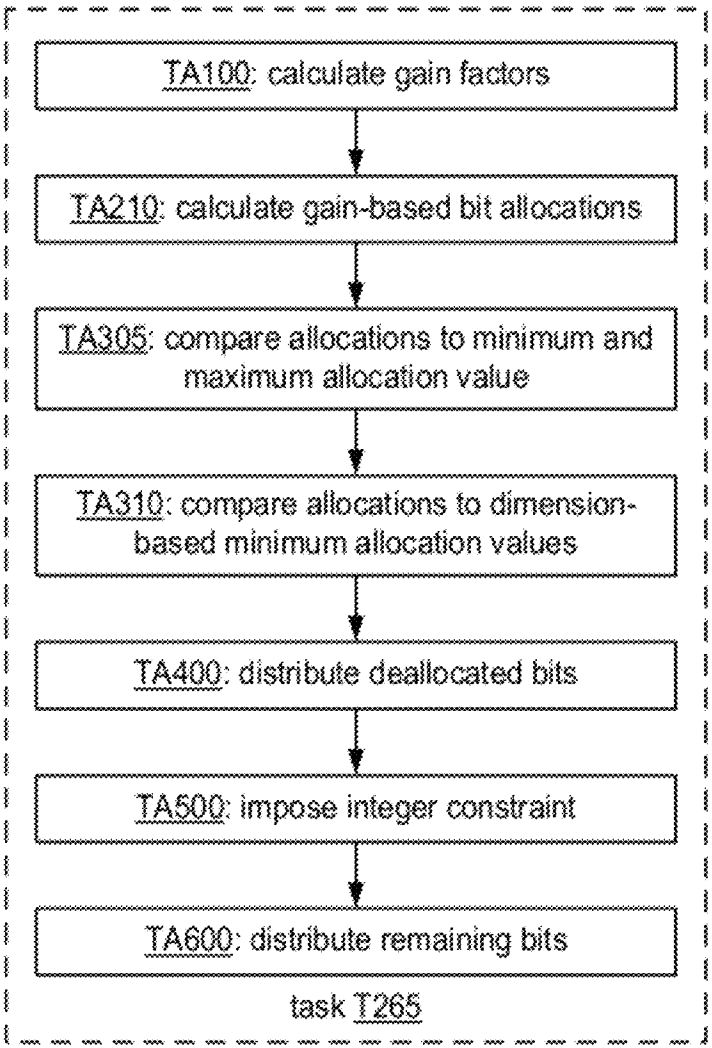
FIG. 7B shows a flowchart for an implementation T265 of dynamic allocation task T260.

FIG. 7B shows a flowchart for an implementation T265 of dynamic allocation task T260 that also includes an instance of task TA310.

Figure 8A:
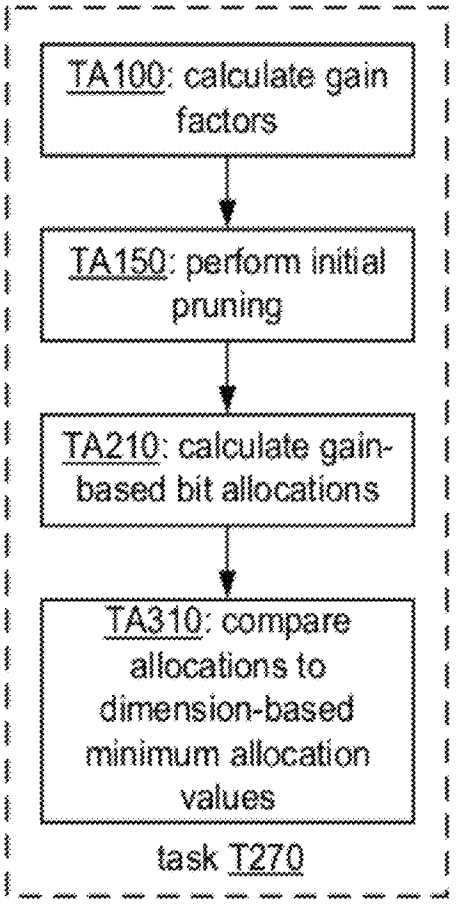
FIG. 8A shows a flowchart of an implementation TA270 of dynamic bit allocation task T230.

FIG. 8A shows a flowchart of an implementation TA270 of dynamic bit allocation task T230 that includes a pruning subtask TA150. Task TA150 performs an initial pruning of a set $S_v$ of vectors to be quantized (e.g., shape vectors), based on the calculated gain factors. For example, task TA150 may be implemented to remove low-energy vectors from consideration, where the energy of a vector may be calculated as the squared open-loop gain. Task TA150 may be configured, for example, to prune vectors whose energies are less than (alternatively, not greater than) a threshold value $T_s$. In one particular example, the value of $T_s$ is 316. Task TA150 may also be configured to terminate task T270 if the average energy per vector is trivial (e.g., not greater than 100).

Task TA150 may be configured to calculate a maximum number of vectors to prune $P_{max}$ based on a total number of bits B to be allocated to set $S_v$ divided by a maximum number of bits $B_{max}$ to be allocated to any one vector. In one example, task TA150 calculates $P_{max}$ by subtracting ceil($B/B_{max}$) from M, where M is the number of vectors in $S_v$. For a case in which too many vectors are pruned, task TA150 may be configured to un-prune the vector having the maximum energy among the currently pruned vectors until no more than the maximum number of vectors are pruned.

Figure 8B:
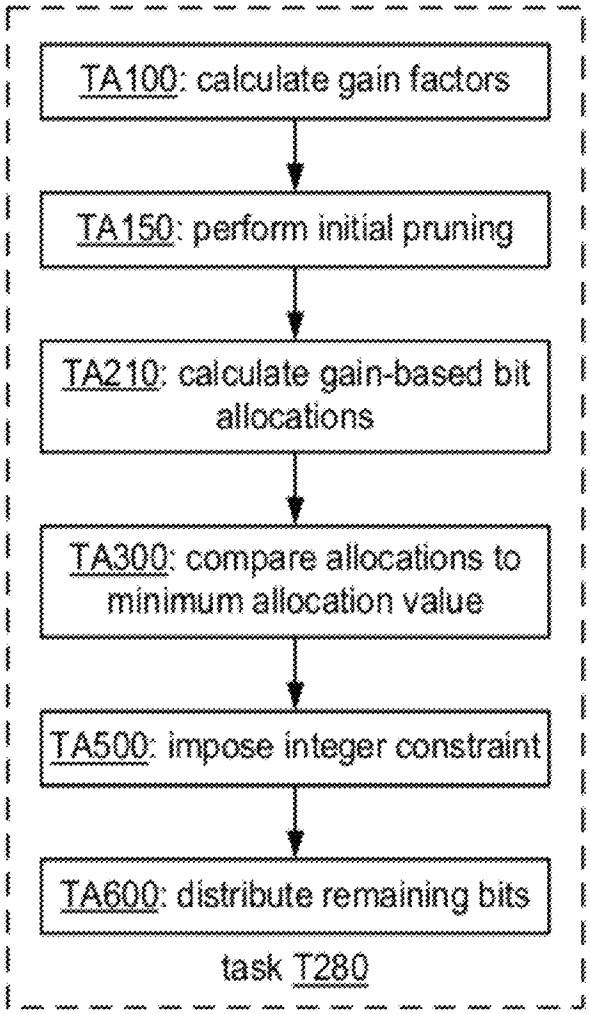
FIG. 8B shows a block diagram of an implementation T280 of dynamic bit allocation task T220.

FIG. 8B shows a block diagram of an implementation T280 of dynamic bit allocation task T220 that includes pruning task TA150, integer constraint task TA500, and distribution task TA600. It is noted in particular that task T280 may be implemented to produce a result that depends only on the input gain values, such that the encoder and decoder may perform task T280 on the same dequantized gain values to obtain the same bit allocations without transmitting any side information. It is also noted that task T280 may be implemented to include instances of tasks TA310 and/or TA400 as described herein, and that additionally or in the alternative, task TA300 may be implemented as task TA305. The pseudo-code listing in Listing A describes a particular implementation of task T280.

In order to support a dynamic allocation scheme, it may be desirable to implement the shape quantizer (and the corresponding dequantizer) to select from among codebooks of different sizes (i.e., from among codebooks having different index lengths) in response to the particular number of bits that are allocated for each shape to be quantized. In such an example, shape quantizer SQ100 (or SQ110) may be implemented to use a codebook having a shorter index length to encode the shape of a subband vector whose open-loop gain is low, and to use a codebook having a longer index length to encode the shape of a subband vector whose open-loop gain is high. Such a dynamic allocation scheme may be configured to use a mapping between vector gain and shape codebook index length that is fixed or otherwise deterministic such that the corresponding dequantizer may apply the same scheme without any additional side information.

Figure 9:
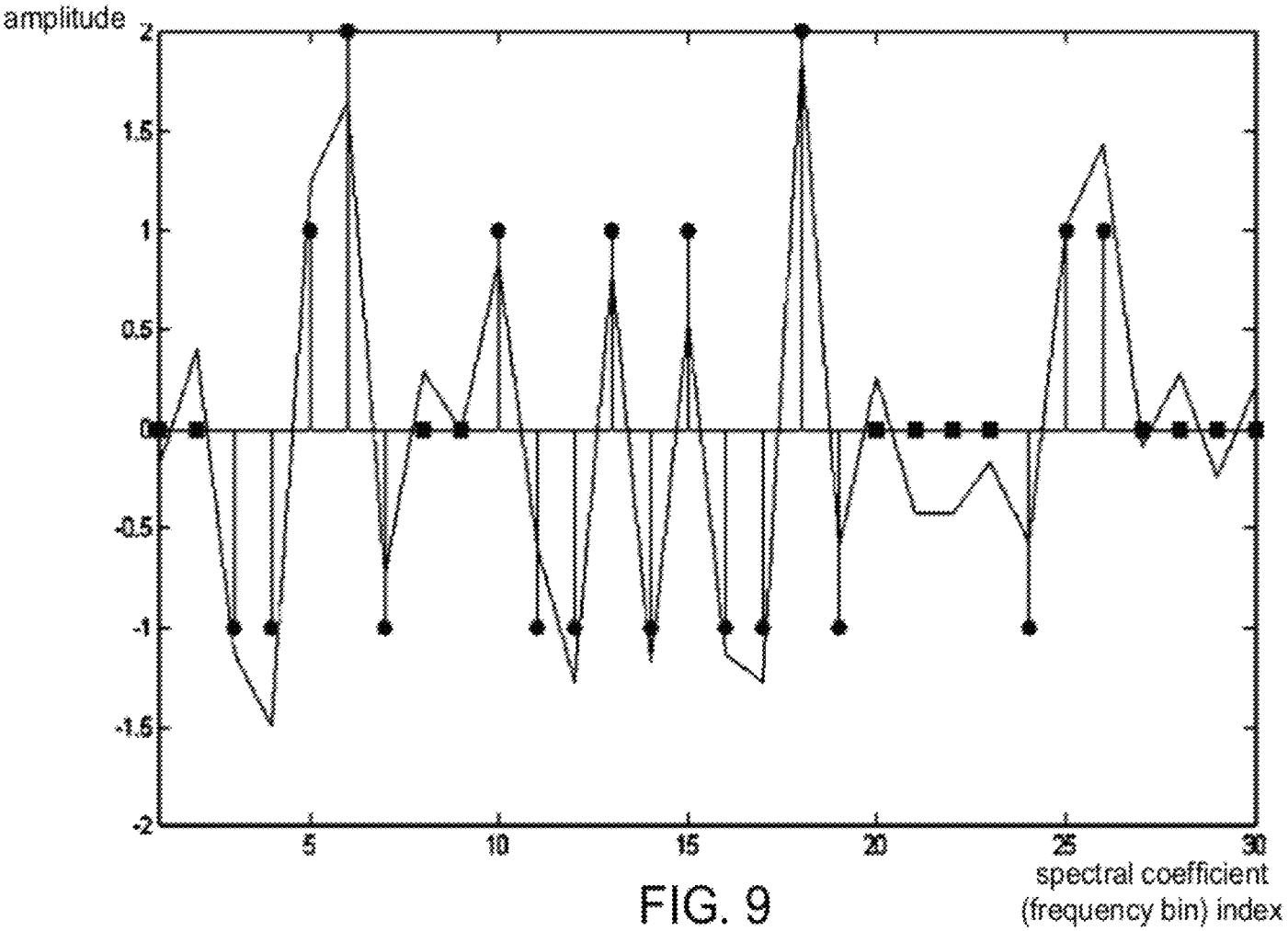
FIG. 9 shows an example of pulse coding.

Another type of vector encoding operation is a pulse coding scheme (e.g., factorial pulse coding or combinatorial pulse coding), which encodes a vector by matching it to a pattern of unit pulses and using an index which identifies that pattern to represent the vector. FIG. 9 shows an example in which a thirty-dimensional vector, whose value at each dimension is indicated by the solid line, is represented by the pattern of pulses (0, 0, −1, −1, +1, +2, −1, 0, 0, +1, −1, −1, +1, −1, +1, −1, −1, +2, −1, 0, 0, 0, 0, −1, +1, +1, 0, 0, 0, 0), as indicated by the dots. This pattern of pulses can typically be represented by an index that is much less than thirty bits. It may be desirable to use a pulse coding scheme for general vector quantization (e.g., of a residual) and/or for shape quantization.

Changing a quantization bit allocation in increments of one bit (i.e., imposing a fixed quantization granularity of one bit or "integer granularity") is relatively straightforward in conventional VQ, which can typically accommodate an arbitrary integer codebook vector length. Pulse coding operates differently, however, in that the size of the quantization domain is determined not by the codebook vector length, but rather by the maximum number of pulses that may be encoded for a given input vector length. When this maximum number of pulses changes by one, the codebook vector length may change by an integer greater than one (i.e., such that the quantization granularity is variable). Consequently, changing a pulse coding quantization bit allocation in steps of one bit (i.e., imposing integer granularity) may result in allocations that are not valid. Quantization granularity for a pulse coding scheme tends to be larger at low bit rates and to decrease to integer granularity as the bit rate increases.

Figure 8C:
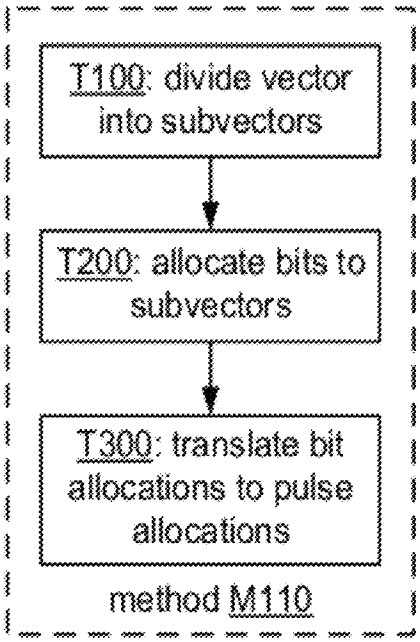
FIG. 8C shows a flowchart of an implementation M110 of method M100.

The length of the pulse coding index determines the maximum number of pulses in the corresponding pattern. As noted above, not all integer index lengths are valid, as increasing the length of a pulse coding index by one does not necessarily increase the number of pulses that may be represented by the corresponding patterns. Consequently, it may be desirable for a pulse-coding application of dynamic allocation task T200 to include a task which translates the bit allocations produced by task T200 (which are not necessarily valid in the pulse-coding scheme) into pulse allocations. FIG. 8C shows a flowchart of an implementation M110 of method M100 that includes such a task T300, which may be implemented to verify whether an allocation is a valid index length in the pulse codebook and to reduce an invalid allocation to the highest valid index length that is less than the invalid allocation.

It is also contemplated to use method M100 for a case that uses both conventional VQ and pulse coding VQ (for example, in which some of the set of vectors are to be encoded using a conventional VQ scheme, and at least one of the vectors is to be encoded using a pulse-coding scheme instead).

Figure 10B:
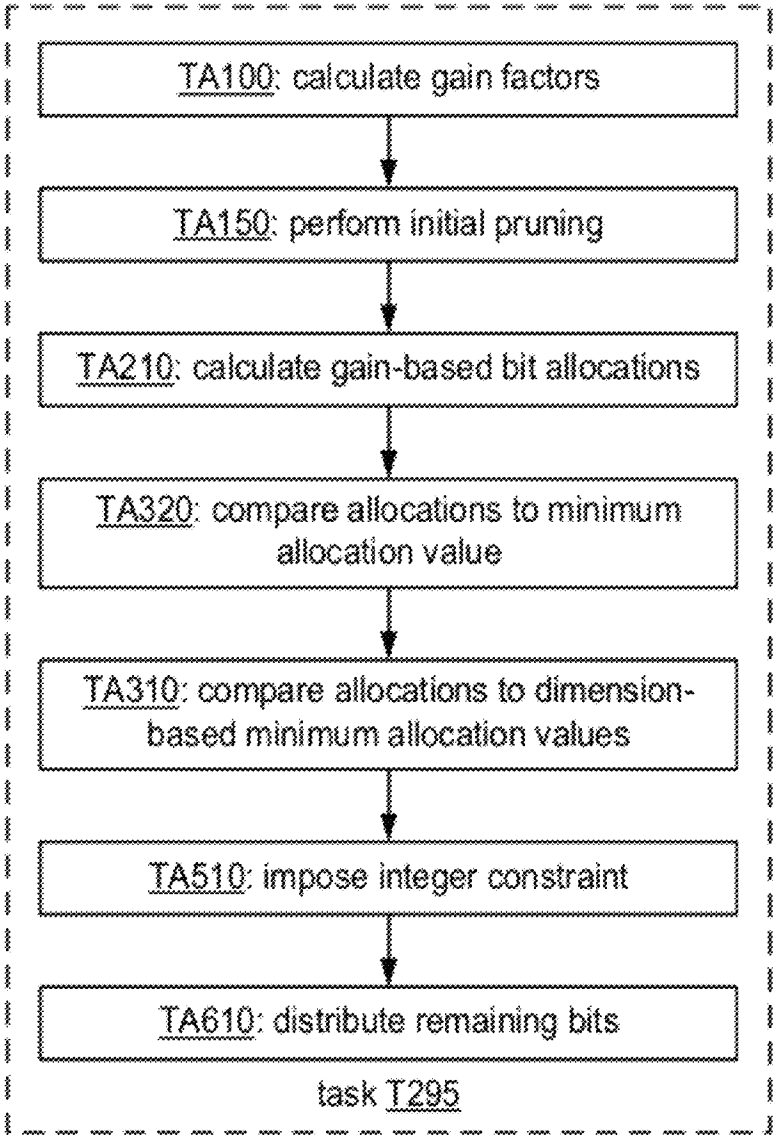
FIG. 10B shows a flowchart for an implementation T295 of dynamic allocation task T290.
Figure 10A:
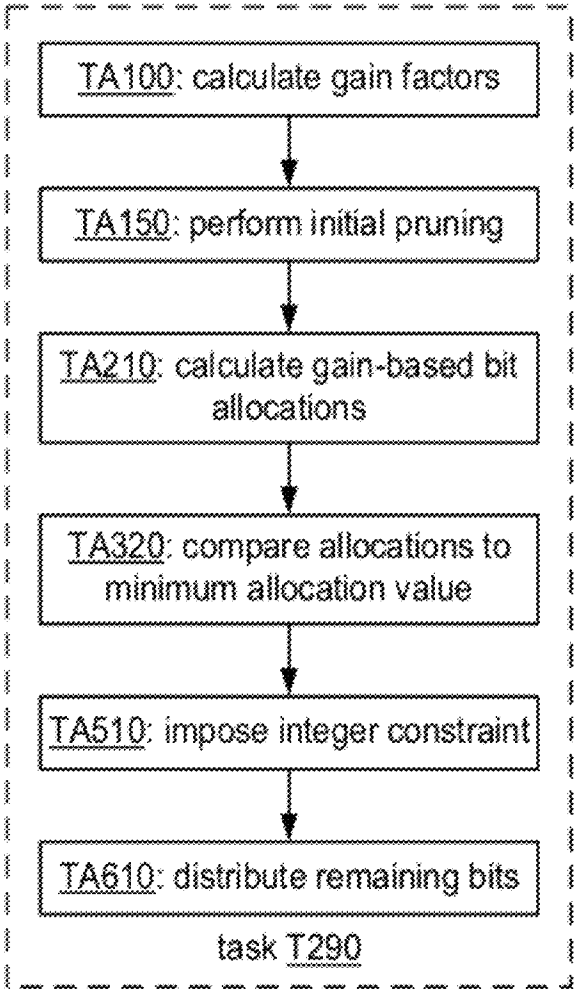
FIG. 10A shows a block diagram of an implementation T290 of task T280.

FIG. 10A shows a block diagram of an implementation T290 of task T280 that includes implementations TA320, TA510, and TA610 of tasks TA300, TA500, and TA600, respectively. In this example, the input vectors are arranged such that the last of the m subbands under allocation (in the zero-based indexing convention used in the pseudocode, the subband with index m−1) is to be encoded using a pulse coding scheme (e.g., factorial pulse coding or combinatorial pulse coding), while the first (m−1) subbands are to be encoded using conventional VQ. For the subbands to be encoded using conventional (e.g., non-pulse) VQ, the bit allocations are calculated according to an integer constraint as described above. For the subband to be pulse coded, the bit allocation is calculated according to an integer constraint on the maximum number of pulses to be encoded. In one example of an application of such a scheme, a selected set of perceptually significant subbands is encoded using conventional VQ, and the corresponding residual (e.g., a concatenation of the non-selected samples, or a difference between the original frame and the coded selected subbands) is encoded using pulse coding. It is understood that although task T280 is described with reference to pulse coding of one vector, task T280 may also be implemented for pulse coding of multiple vectors (e.g., a plurality of subvectors of a residual, such as shown in FIG. 3).

Task TA320 may be implemented to impose upper and/or lower caps on the initial bit allocations as described above with reference to task TA300 and TA305. In this case, the subband to be pulse coded is excluded from the test for over- and/or under-allocations. Task TA320 may also be implemented to exclude this subband from the reallocation performed after each correction.

Task TA510 imposes an integer constraint on the bit allocations $B_m$ for the conventional VQ subbands by truncating each allocation $B_m$ to the largest integer not greater than $B_m$. Task TA510 also reduces the initial bit allocation $B_m$ for the subband to be pulse coded as appropriate by applying an integer constraint on the maximum number of pulses to be encoded. Task TA510 may be configured to apply this pulse-coding integer constraint by calculating the maximum number of pulses that may be encoded with the initial bit allocation $B_m$, given the length of the subband vector to be pulse coded, and then replacing the initial bit allocation $B_m$ with the actual number of bits needed to encode that maximum number of pulses for such a vector length.

Task TA510 also updates the value of $B_{av}$ according to an expression such as $B-\Sigma_{m=1}^{M}B_m$. Task TA510 may be configured to determine whether $B_{av}$ is at least as large as the number of bits needed to increase the maximum number of pulses in the pulse-coding quantization by one, and to adjust the pulse-coding bit allocation and $B_{av}$ accordingly. Task TA510 may also be configured to store the truncated residue for each subband vector to be encoded using conventional VQ in a corresponding element of an error array $\Delta B$.

Task TA610 distributes the remaining $B_{av}$ bits. Task TA610 may be configured to distribute the remaining bits to the subband vectors to be coded using conventional VQ that correspond to the highest values in error array $\Delta B$. Task TA610 may also be configured to use any remaining bits to increase the bit allocation if possible for the subband to be pulse coded, for a case in which all conventional VQ bit allocations are at $B_{max}$.

The pseudo-code listing in Listing B describes a particular implementation of task T280 that includes a helper function find_fpc_pulses. For a given vector length and bit allocation limit, this function returns the maximum number of pulses that can be coded, the number of bits needed to encode that number of pulses, and the number of additional bits that would be needed if the maximum number of pulses were incremented.

FIG. 10B shows a flowchart for an implementation T295 of dynamic allocation task T290 that also includes an instance of task TA310.

A sparse signal is often easy to code because a few parameters (or coefficients) contain most of the signal's information. In coding a signal with both sparse and non-sparse components, it may be desirable to assign more bits to code the non-sparse components than sparse components. It may be desirable to emphasize non-sparse components of a signal to improve the coding performance of these components. Such an approach focuses on a measure of distribution of energy with the vector (e.g., a measure of sparsity) to improve the coding performance for a specific signal class compared to others, which may help to ensure that non-sparse signals are well represented and to boost overall coding performance.

A signal that has more energy may take more bits to code. A signal that is less sparse similarly may take more bits to code than one that has the same energy but is more sparse. A signal that is very sparse (e.g., just a single pulse) is typically very easy to code, while a signal that is very distributed (e.g., very noise-like), is typically much harder to code, even if the two signals have the same energy. It may be desirable to configure a dynamic allocation operation to account for the effect of relative sparsities of subbands on their respective relative coding difficulties. For example, such a dynamic allocation operation may be configured to weight the allocation for a less-sparse signal more heavily than the allocation for a signal having the same energy that is more sparse.

In an example as applied to a model-guided coding, concentration of the energy in a subband indicates that the model is a good fit to the input signal, such that a good coding quality may be expected from a low bit allocation. For harmonic-model coding as described herein and as applied to a high-band, such a case may arise with a single-instrument musical signal. Such a signal may be referred to as "sparse." Alternatively, a flat distribution of the energy may indicate that the model does not capture the structure of the signal as well, such that it may be desirable to use a higher bit allocation to maintain a desired perceptual quality. Such a signal may be referred to as "non-sparse."

Figure 11B:
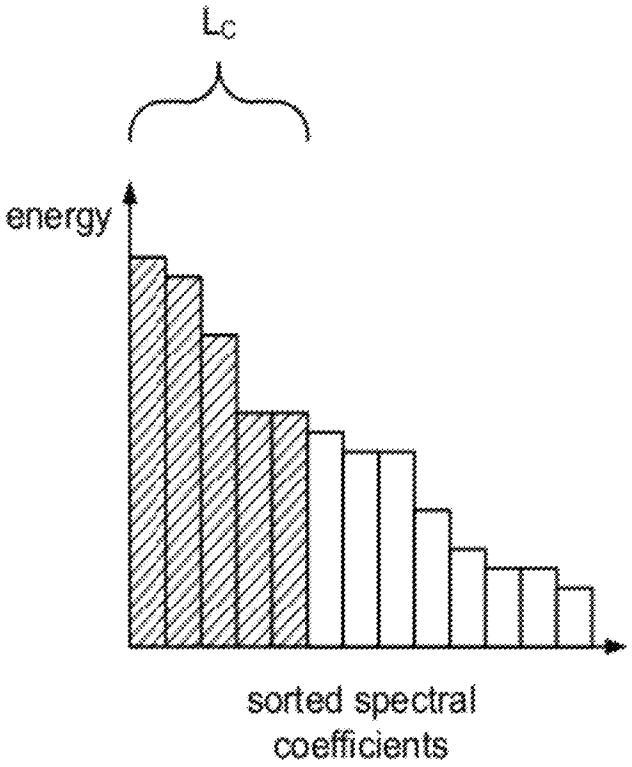
FIG. 11B shows an example of a subset in a set of sorted spectral coefficients.
Figure 11A:
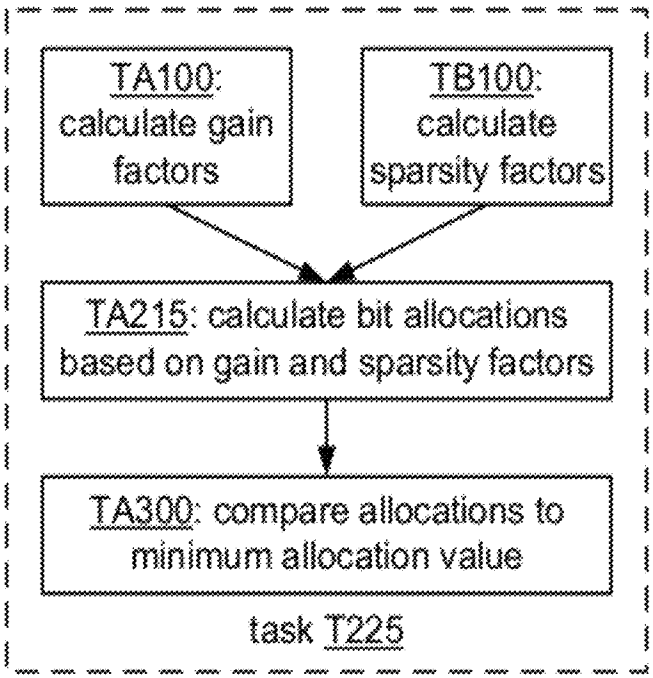
FIG. 11A shows a flowchart for an implementation T225 of dynamic allocation task T220.

FIG. 11A shows a flowchart for an implementation T225 of dynamic allocation task T220 that includes a subtask TB100 and an implementation TA215 of allocation calculation task TA210. For each of the plurality of vectors, task TB100 calculates a corresponding value of a measure of distribution of energy within the vector (i.e., a sparsity factor). Task TB100 may be configured to calculate the sparsity factor based on a relation between a total energy of the subband and a total energy of a subset of the coefficients of the subband. In one such example, the subset is the $L_c$ largest (i.e., maximum-energy) coefficients of the subband (e.g., as shown in FIG. 11B). Examples of values for $L_C$ include 5, 10, 15, and 20 (e.g., five, seven, ten, fifteen, or twenty percent of the total number of coefficients in the subband). In this case, it may be understood that the relation between these values [e.g., (energy of subset)/(total subband energy)] indicates a degree to which energy of the subband is concentrated or distributed. Similarly, task TB100 may be configured to calculate the sparsity factor based on the number of the largest coefficients of the subband that is sufficient to reach an energy sum that is a specified portion (e.g., 5, 10, 12, 15, 20, 25, or 30 percent) of the total subband energy. Task TB100 may include sorting the energies of the coefficients of the subband.

Task TA215 calculates the bit allocations for the vectors based on the corresponding gain and sparsity factors. Task TA215 may be implemented to divide the total available bit allocation among the subbands in proportion to the values of their corresponding sparsity factors such that more bits are allocated to the less concentrated subband or subbands. In one such example, task TA215 is configured to map sparsity factors that are less than a threshold value $s_L$ to one, to map sparsity factors that are greater than a threshold value $s_H$ to a value R that is less than one (e.g., R=0.7), and to linearly map sparsity factors from $s_L$ to $s_H$ to the range of 1 to R. In such case, task TA215 may be implemented to calculate the bit allocation $B_m$ for each vector m as the value $v \times B \times (D_m/D_h) + a \log_2(E_m/D_m) - bF_z$, where $F_z$ is calculated as the sum $\Sigma[(D_m/D_h) \times \log_2(E_m/D_m)]$ over all vectors m. Example values for each of the factors a and b include 0.5. For a case in which the vectors m are unit-norm vectors (e.g., shape vectors), the energy $E_m$ of each vector in task TA210 is the corresponding gain factor.

It is expressly noted that any of the instances of task TA210 described herein may be implemented as an instance of task TA215 (e.g., with a corresponding instance of sparsity factor calculation task TB100). An encoder performing such a dynamic allocation task may be configured to transmit an indication of the sparsity and gain factors, such that the decoder may derive the bit allocation from these values. In a further example, an implementation of task TA210 as described herein may be configured to calculate the bit allocations based on information from an LPC operation (e.g., in addition to or in the alternative to vector dimension and/or sparsity). For example, such an implementation of task TA210 may be configured to produce the bit allocations according to a weighting factor that is proportional to spectral tilt (i.e., the first reflection coefficient). In one such case, the allocations for vectors corresponding to low-frequency bands may be weighted more or less heavily based on the spectral tilt for the frame.

Alternatively or additionally, a sparsity factor as described herein may be used to select or otherwise calculate a value of a modulation factor for the corresponding subband. The modulation factor may then be used to modulate (e.g., to scale) the coefficients of the subband. In a particular example, such a sparsity-based modulation scheme is applied to encoding of the highband.

In an open-loop gain-coding case, it may be desirable to configure the decoder (e.g., the gain dequantizer) to multiply the open-loop gain by a factor $\gamma$ that is a function of the number of bits that was used to encode the shape (e.g., the lengths of the indices to the shape codebook vectors). When very few bits are used to quantize the shape, the shape quantizer is likely to produce a large error such that the vectors S and $\hat{S}$ may not match very well, so it may be desirable at the decoder to reduce the gain to reflect that error. The correction factor $\gamma$ represents this error only in an average sense: it only depends on the codebook (specifically, on the number of bits in the codebooks) and not on any particular detail of the input vector x. The codec may be configured such that the correction factor $\gamma$ is not transmitted, but rather is just read out of a table by the decoder according to how many bits were used to quantize vector $\hat{S}$.

This correction factor $\gamma$ indicates, based on the bit rate, how close on average vector $\hat{S}$ may be expected to approach the true shape S. As the bit rate goes up, the average error will decrease and the value of correction factor $\gamma$ will approach one, and as the bit rate goes very low, the correlation between S and vector $\hat{S}$ (e.g., the inner product of vector $\hat{S}^T$ and S) will decrease, and the value of correction factor $\gamma$ will also decrease. While it may be desirable to obtain the same effect as in the closed-loop gain (e.g., on an actual input-by-input, adaptive sense), for the open-loop case the correction is typically available only in an average sense.

Alternatively, a sort of an interpolation between the open-loop and closed-loop gain methods may be performed. Such an approach augments the open-loop gain expression with a dynamic correction factor that is dependent on the quality of the particular shape quantization, rather than just a length-based average quantization error. Such a factor may be calculated based on the dot product of the quantized and unquantized shapes. It may be desirable to encode the value of this correction factor very coarsely (e.g., as an index into a four- or eight-entry codebook) such that it may be transmitted in very few bits.

Figure 12B:
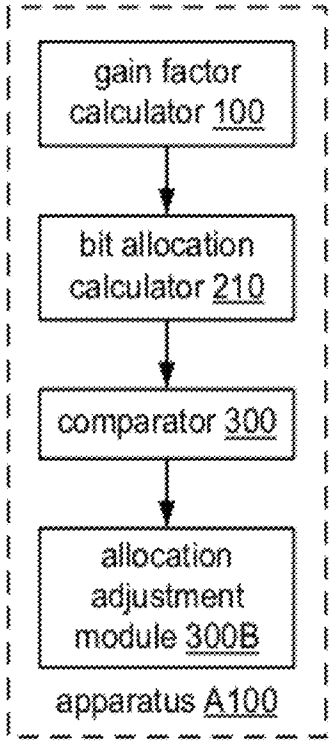
FIG. 12B shows a block diagram of an apparatus for bit allocation A100 according to a general configuration.
Figure 12A:
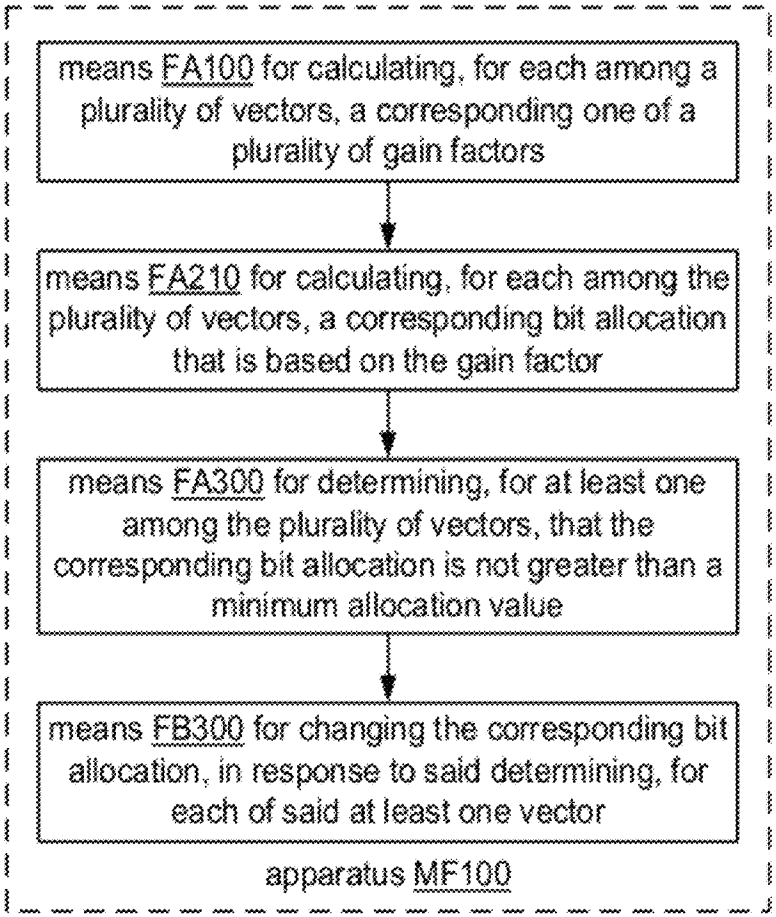
FIG. 12A shows a block diagram of an apparatus for bit allocation MF100 according to a general configuration.

FIG. 12A shows a block diagram of an apparatus for bit allocation MF100 according to a general configuration. Apparatus MF100 includes means FA100 for calculating, for each among a plurality of vectors, a corresponding one of a plurality of gain factors (e.g., as described herein with reference to implementations of task TA100). Apparatus MF100 also includes means FA210 for calculating, for each among the plurality of vectors, a corresponding bit allocation that is based on the gain factor (e.g., as described herein with reference to implementations of task TA210). Apparatus MF100 also includes means FA300 for determining, for at least one among the plurality of vectors, that the corresponding bit allocation is not greater than a minimum allocation value (e.g., as described herein with reference to implementations of task TA300). Apparatus MF100 also includes means FB300 for changing the corresponding bit allocation, in response to said determining, for each of said at least one vector (e.g., as described herein with reference to implementations of task TA300).

FIG. 12B shows a block diagram of an apparatus for bit allocation A100 according to a general configuration that includes a gain factor calculator 100, a bit allocation calculator 210, a comparator 300, and an allocation adjustment module 300B. Gain factor calculator 100 is configured to calculate, for each among a plurality of vectors, a corresponding one of a plurality of gain factors (e.g., as described herein with reference to implementations of task TA100). Bit allocation calculator 210 is configured to calculate, for each among the plurality of vectors, a corresponding bit allocation that is based on the gain factor (e.g., as described herein with reference to implementations of task TA210). Comparator 300 is configured to determine, for at least one among the plurality of vectors, that the corresponding bit allocation is not greater than a minimum allocation value (e.g., as described herein with reference to implementations of task TA300). Allocation adjustment module 300B is configured to change the corresponding bit allocation, in response to said determining, for each of said at least one vector (e.g., as described herein with reference to implementations of task TA300). Apparatus A100 may also be implemented to include a frame divider configured to divide a frame into a plurality of subvectors (e.g., as described herein with reference to implementations of task T100).

Figure 13A:
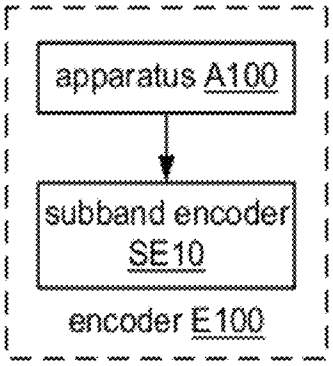
FIG. 13A shows a block diagram of an encoder E100 according to a general configuration.
Figure 13B:
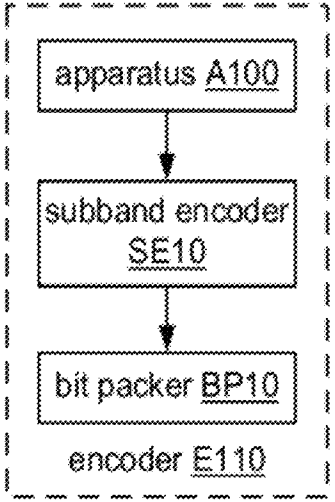
FIG. 13B shows a block diagram of an implementation E110 of encoder E100.
Figure 13C:
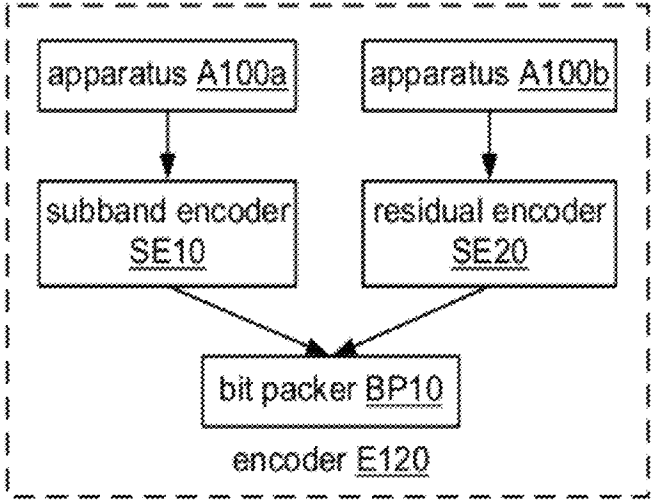
FIG. 13C shows a block diagram of an implementation E120 of encoder E110.
Figure 13D:
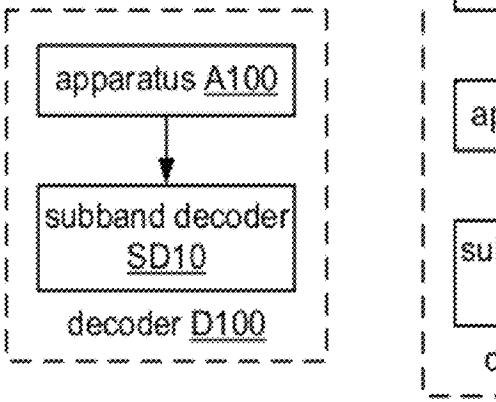
FIG. 13D shows a block diagram of a corresponding decoder D100.
Figure 13E:
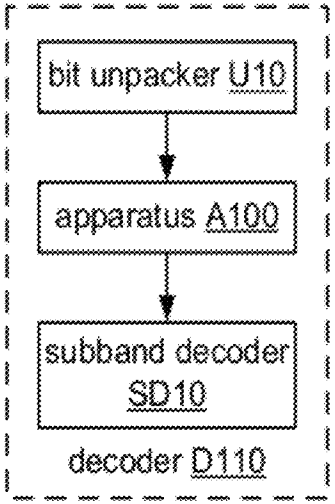
FIG. 13E shows a block diagram of a corresponding implementation D110 of decoder D100.
Figure 13F:
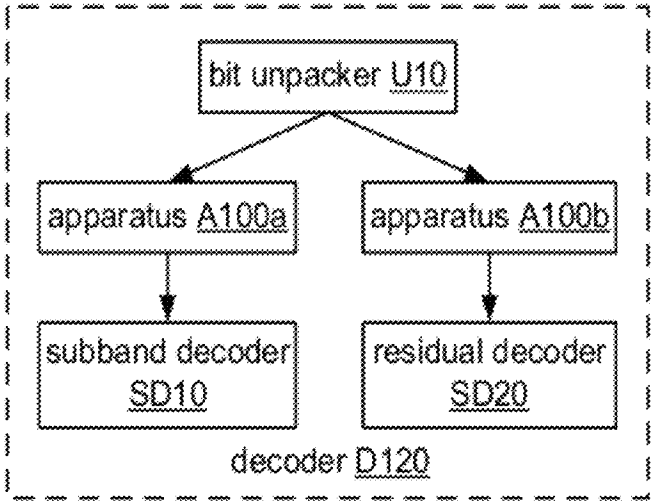
FIG. 13F shows a block diagram of a corresponding implementation D120 of decoder D100.

FIG. 13A shows a block diagram of an encoder E100 according to a general configuration that includes an instance of apparatus A100 and a subband encoder SE10. Subband encoder SE10 is configured to quantize the plurality of vectors (or a plurality of vectors based thereon, such as a corresponding plurality of shape vectors) according to the corresponding allocations calculated by apparatus A100. For example, subband encoder SE10 may be configured to perform a conventional VQ coding operation and/or a pulse-coding VQ operation as described herein. FIG. 13D shows a block diagram of a corresponding decoder D100 that includes an instance of apparatus A100 and a subband decoder SD10 that is configured to dequantize the plurality of vectors (or a plurality of vectors based thereon, such as a corresponding plurality of shape vectors) according to the corresponding allocations calculated by apparatus A100. FIG. 13B shows a block diagram of an implementation E110 of encoder E100 that includes a bit packer BP10 configured to pack the encoded subbands into frames that are compliant with one or more codecs as described herein (e.g., EVRC, AMR-WB). FIG. 13E shows a block diagram of a corresponding implementation D110 of decoder D100 that includes a corresponding bit unpacker U10. FIG. 13C shows a block diagram of an implementation E120 of encoder E110 that includes instances A100*a* and A100*b* of apparatus A100 and a residual encoder SE20. In this case, subband encoder SE10 is arranged to quantize a first plurality of vectors (or a plurality of vectors based thereon, such as a corresponding plurality of shape vectors) according to the corresponding allocations calculated by apparatus A100*a*, and residual encoder SE20 is configured to quantize a second plurality of vectors (or a plurality of vectors based thereon, such as a corresponding plurality of shape vectors) according to the corresponding allocations calculated by apparatus A100*b*. FIG. 13F shows a block diagram of a corresponding implementation D120 of decoder D100 that includes a corresponding residual decoder SD20 that is configured to dequantize the second plurality of vectors (or a plurality of vectors based thereon, such as a corresponding plurality of shape vectors) according to the corresponding allocations calculated by apparatus A100*b*.

Figure 14:
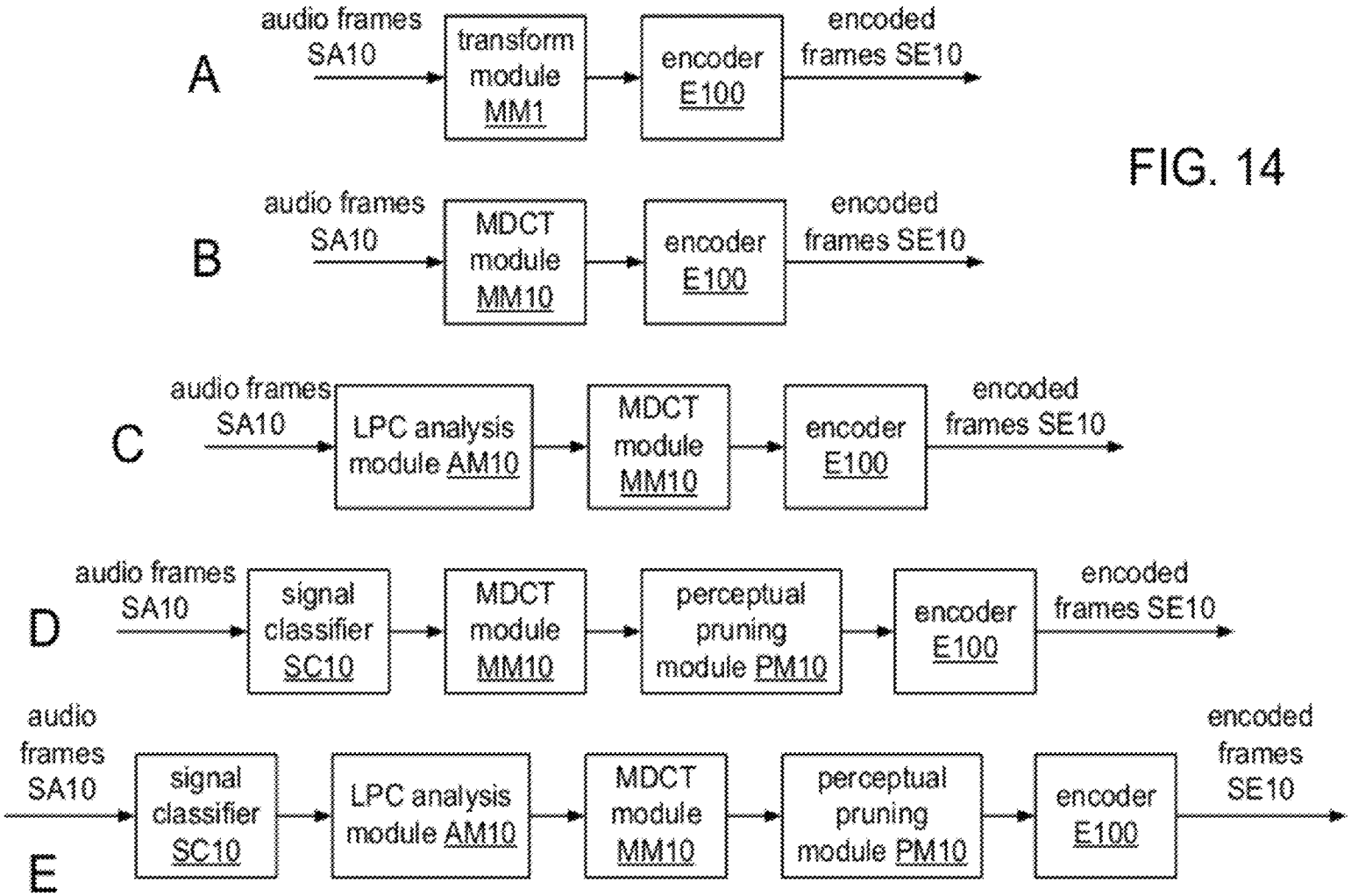
FIGS. 14A-E show a range of applications for encoder E100.

FIGS. 14A-E show a range of applications for encoder E100 as described herein. FIG. 14A shows a block diagram of an audio processing path that includes a transform module MM1 (e.g., a fast Fourier transform or MDCT module) and an instance of encoder E100 that is arranged to receive the audio frames SA10 as samples in the transform domain (i.e., as transform domain coefficients) and to produce corresponding encoded frames SE10.

FIG. 14B shows a block diagram of an implementation of the path of FIG. 14A in which transform module MM1 is implemented using an MDCT transform module. Modified DCT module MM10 performs an MDCT operation on each audio frame to produce a set of MDCT domain coefficients.

FIG. 14C shows a block diagram of an implementation of the path of FIG. 14A that includes a linear prediction coding analysis module AM10. Linear prediction coding (LPC) analysis module AM10 performs an LPC analysis operation on the classified frame to produce a set of LPC parameters (e.g., filter coefficients) and an LPC residual signal. In one example, LPC analysis module AM10 is configured to perform a tenth-order LPC analysis on a frame having a bandwidth of from zero to 4000 Hz. In another example, LPC analysis module AM10 is configured to perform a sixth-order LPC analysis on a frame that represents a highband frequency range of from 3500 to 7000 Hz. Modified DCT module MM10 performs an MDCT operation on the LPC residual signal to produce a set of transform domain coefficients. A corresponding decoding path may be configured to decode encoded frames SE10 and to perform an inverse MDCT transform on the decoded frames to obtain an excitation signal for input to an LPC synthesis filter.

FIG. 14D shows a block diagram of a processing path that includes a signal classifier SC10. Signal classifier SC10 receives frames SA10 of an audio signal and classifies each frame into one of at least two categories. For example, signal classifier SC10 may be configured to classify a frame SA10 as speech or music, such that if the frame is classified as music, then the rest of the path shown in FIG. 14D is used to encode it, and if the frame is classified as speech, then a different processing path is used to encode it. Such classification may include signal activity detection, noise detection, periodicity detection, time-domain sparseness detection, and/or frequency-domain sparseness detection.

Figure 15A:
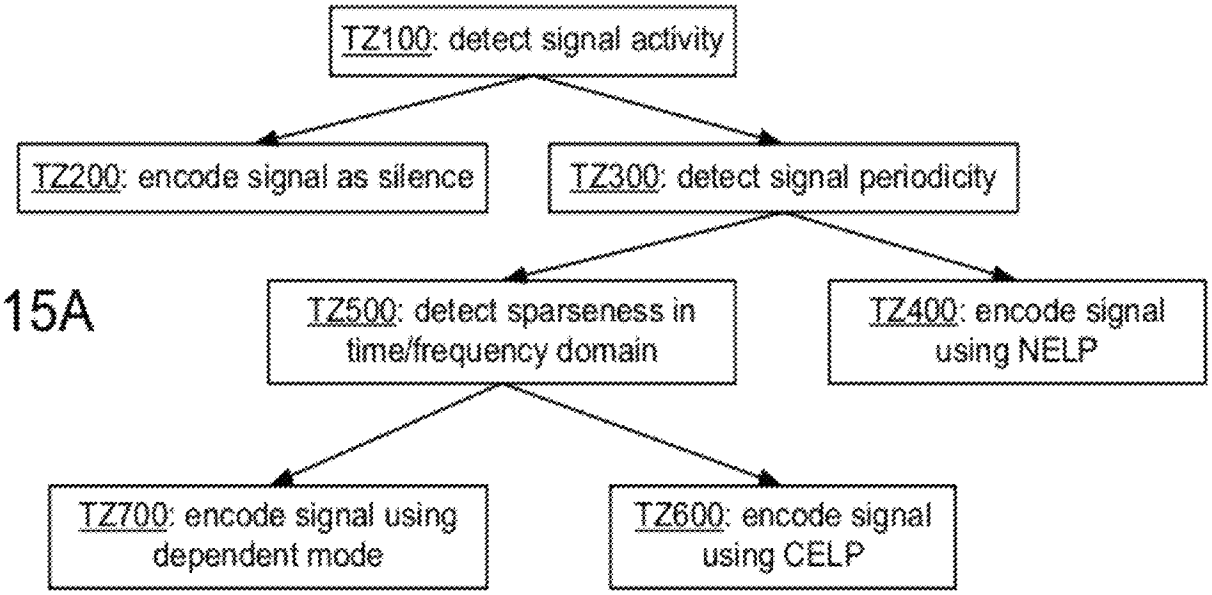
FIG. 15A shows a block diagram of a method MZ100 of signal classification.

FIG. 15A shows a block diagram of a method MZ100 of signal classification that may be performed by signal classifier SC10 (e.g., on each of the audio frames SA10). Method MC100 includes tasks TZ100, TZ200, TZ300, TZ400, TZ500, and TZ600. Task TZ100 quantifies a level of activity in the signal. If the level of activity is below a threshold, task TZ200 encodes the signal as silence (e.g., using a low-bit-rate noise-excited linear prediction (NELP) scheme and/or a discontinuous transmission (DTX) scheme). If the level of activity is sufficiently high (e.g., above the threshold), task TZ300 quantifies a degree of periodicity of the signal. If task TZ300 determines that the signal is not periodic, task TZ400 encodes the signal using a NELP scheme. If task TZ300 determines that the signal is periodic, task TZ500 quantifies a degree of sparsity of the signal in the time and/or frequency domain. If task TZ500 determines that the signal is sparse in the time domain, task TZ600 encodes the signal using a code-excited linear prediction (CELP) scheme, such as relaxed CELP (RCELP) or algebraic CELP (ACELP). If task TZ500 determines that the signal is sparse in the frequency domain, task TZ700 encodes the signal using a harmonic model (e.g., by passing the signal to the rest of the processing path in FIG. 14D).

As shown in FIG. 14D, the processing path may include a perceptual pruning module PM10 that is configured to simplify the MDCT-domain signal (e.g., to reduce the number of transform domain coefficients to be encoded) by applying psychoacoustic criteria such as time masking, frequency masking, and/or hearing threshold. Module PM10 may be implemented to compute the values for such criteria by applying a perceptual model to the original audio frames SA10. In this example, encoder E100 is arranged to encode the pruned frames to produce corresponding encoded frames SE10.

FIG. 14E shows a block diagram of an implementation of both of the paths of FIGS. 14C and 14D, in which encoder E100 is arranged to encode the LPC residual.

Figure 15B:
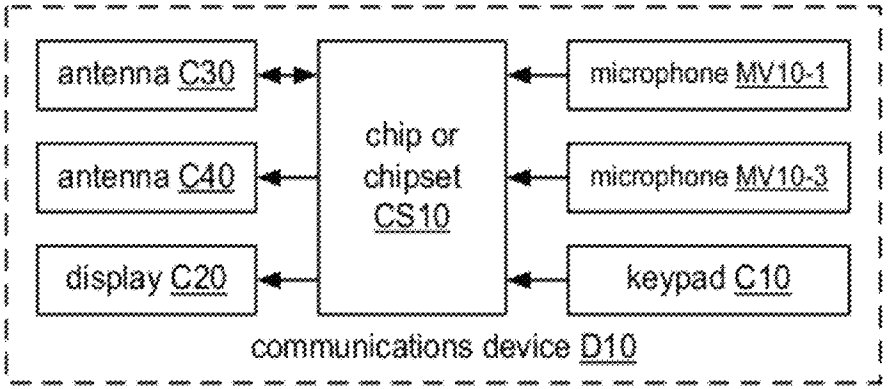
FIG. 15B shows a block diagram of a communications device D10.

FIG. 15B shows a block diagram of a communications device D10 that includes an implementation of apparatus A100. Device D10 includes a chip or chipset CS10 (e.g., a mobile station modem (MSM) chipset) that embodies the elements of apparatus A100 (or MF100) and possibly of apparatus D100 (or DF100). Chip/chipset CS10 may include one or more processors, which may be configured to execute a software and/or firmware part of apparatus A100 or MF100 (e.g., as instructions).

Chip/chipset CS10 includes a receiver, which is configured to receive a radio-frequency (RF) communications signal and to decode and reproduce an audio signal encoded within the RF signal, and a transmitter, which is configured to transmit an RF communications signal that describes an encoded audio signal (e.g., including codebook indices as produced by apparatus A100) that is based on a signal produced by microphone MV10. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). For example, chip or chipset CS10 may be configured to produce the encoded frames to be compliant with one or more such codecs.

Device D10 is configured to receive and transmit the RF communications signals via an antenna C30. Device D10 may also include a diplexer and one or more power amplifiers in the path to antenna C30. Chip/chipset CS10 is also configured to receive user input via keypad C10 and to display information via display C20. In this example, device D10 also includes one or more antennas C40 to support Global Positioning System (GPS) location services and/or short-range communications with an external device such as a wireless (e.g., Bluetooth™) headset. In another example, such a communications device is itself a Bluetooth™ headset and lacks keypad C10, display C20, and antenna C30.

Figure 16:
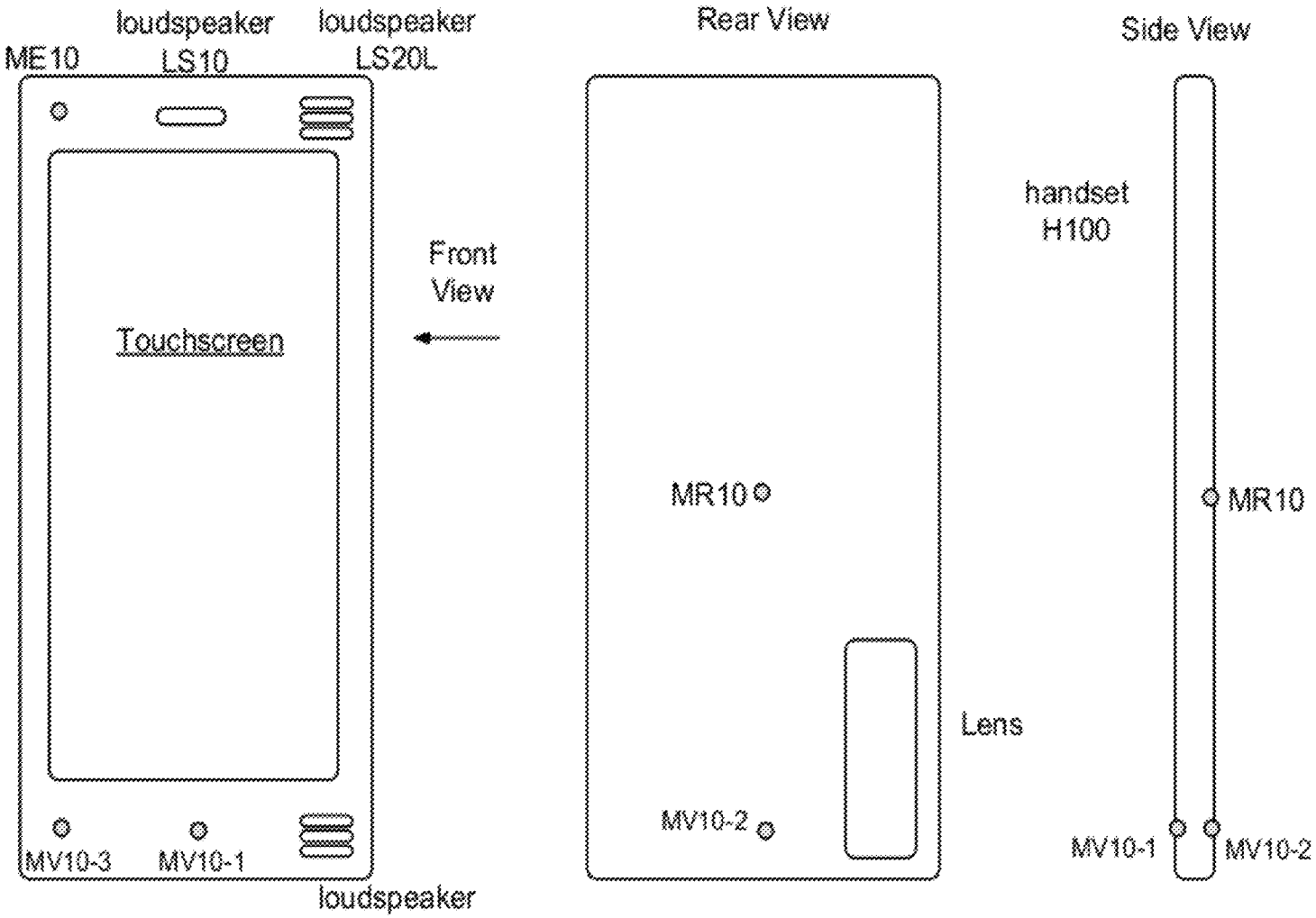
FIG. 16 shows front, rear, and side views of a handset H100.

Communications device D10 may be embodied in a variety of communications devices, including smartphones and laptop and tablet computers. FIG. 16 shows front, rear, and side views of a handset H100 (e.g., a smartphone) having two voice microphones MV10-1 and MV10-3 arranged on the front face, a voice microphone MV10-2 arranged on the rear face, an error microphone ME10 located in a top corner of the front face, and a noise reference microphone MR10 located on the back face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

Figure 17:
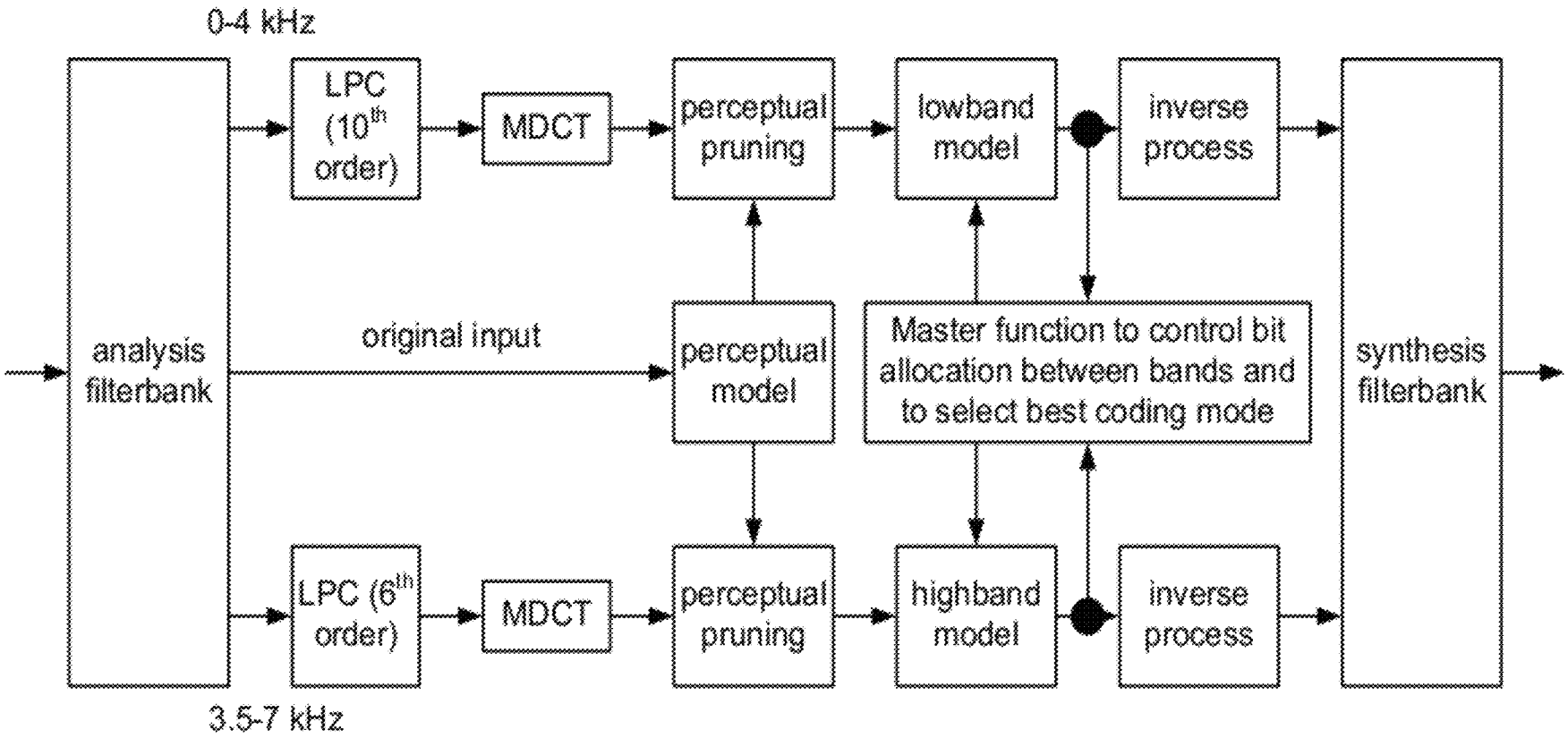
FIG. 17 shows a block diagram of an example of a multi-band coder.
Figure 18:
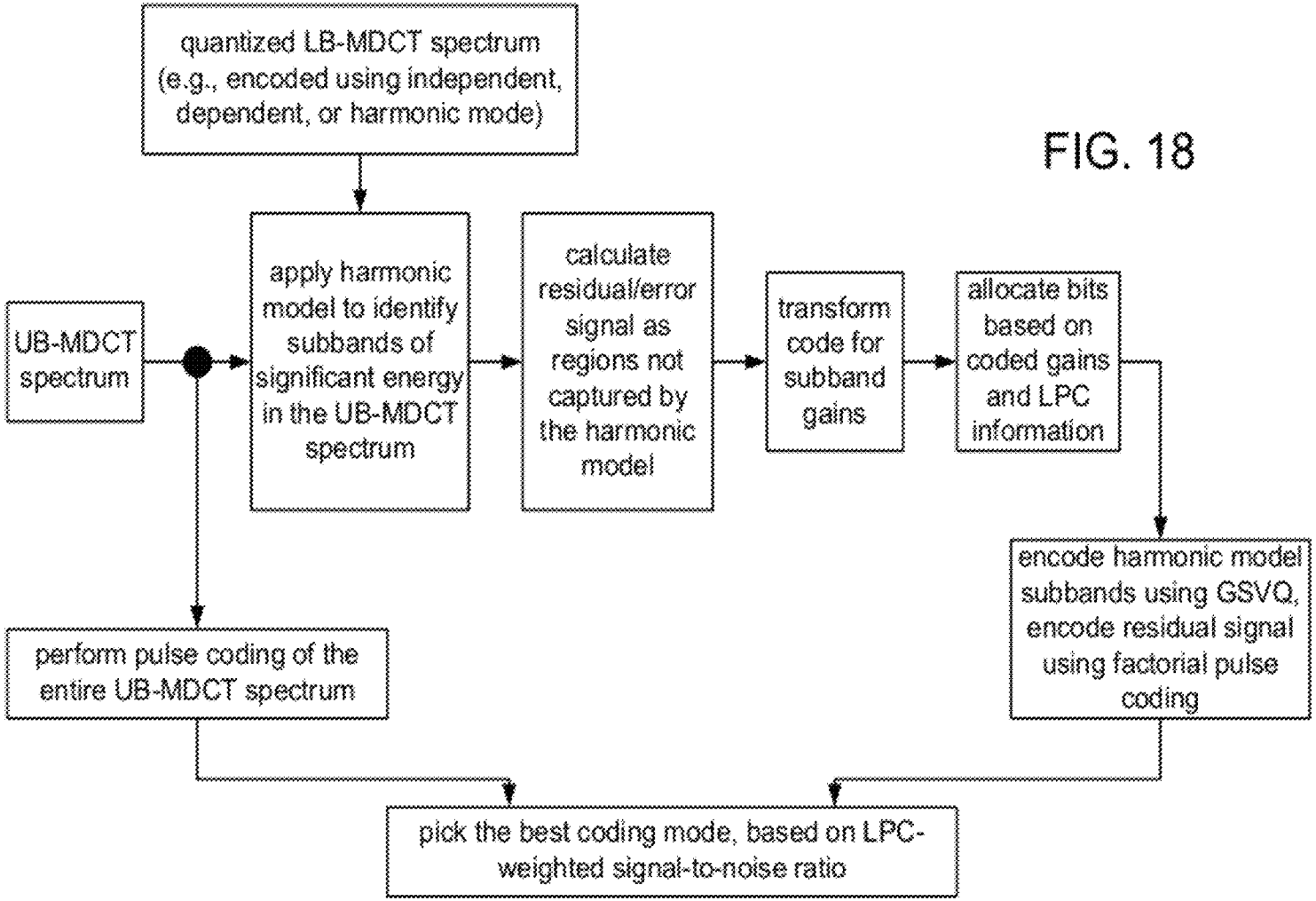
FIG. 18 shows a flowchart of an example of method for multi-band coding.

In a multi-band coder (e.g., as shown in FIG. 17), it may be desirable to perform closed-loop gain GSVQ in the lowband (e.g., in a dependent-mode or harmonic-mode coder, as described elsewhere herein), and to perform open-loop gain GSVQ with gain-based dynamic bit allocation (e.g., according to an implementation of task T210) among the shapes in the highband. In this example, the lowband frame is the residual of a tenth-order LPC analysis operation on the lowband as produced by the analysis filterbank from an audio-frequency input frame, and the highband frame is the residual of a sixth-order LPC analysis operation on the highband as produced by the analysis filterbank from the audio-frequency input frame. FIG. 18 shows a flowchart of a corresponding method of multi-band coding, in which the bit allocations for the one or more of the indicated codings (i.e., pulse coding of UB-MDCT spectrum, GSVQ encoding of harmonic subbands, and/or pulse coding of residual) may be performed according to an implementation of task T210.

As discussed above, a multi-band coding scheme may be configured such that each of the lowband and the highband is encoded using either an independent coding mode or a dependent (alternatively, a harmonic) coding mode. For a case in which the lowband is encoded using an independent coding mode (e.g., GSVQ applied to a set of fixed subbands), a dynamic allocation as described above may be performed (e.g., according to an implementation of task T210) to allocate a total bit allocation for the frame (which may be fixed or may vary from frame to frame) between the lowband and highband according to the corresponding gains. In such case, another dynamic allocation as described above may be performed (e.g., according to an implementation of task T210) to allocate the resulting lowband bit allocation among the lowband subbands and/or another dynamic allocation as described above may be performed (e.g., according to an implementation of task T210) to allocate the resulting highband bit allocation among the highband subbands.

For a case in which the lowband is encoded using a dependent (alternatively, a harmonic) coding mode, it may be desirable first to allocate bits from the total bit allocation for the frame (which may be fixed or may vary from frame to frame) to the subbands selected by the coding mode. It may be desirable to use information from the LPC spectrum for the lowband for this allocation. In one such example, the LPC tilt spectrum (e.g., as indicated by the first reflection coefficient) is used to determine the subband having the highest LPC weight, and a maximum number of bits (e.g., ten bits) is allocated to that subband (e.g., for shape quantization), with correspondingly lower allocations being given to the subbands with lower LPC weights. A dynamic allocation as described above may then be performed (e.g., according to an implementation of task T210) to allocate the bits remaining in the frame allocation between the lowband residual and the highband. In such case, another dynamic allocation as described above may be performed (e.g., according to an implementation of task T210) to allocate the resulting highband bit allocation among the highband subbands.

A coding mode selection as shown in FIG. 18 may be extended to a multi-band case. In one such example, each of the lowband and the highband is encoded using both an independent coding mode and a dependent coding mode (alternatively, an independent coding mode and a harmonic coding mode), such that four different mode combinations are initially under consideration for the frame. Next, for each of the lowband modes, the best corresponding highband mode is selected (e.g., according to comparison between the two options using a perceptual metric on the highband). Of the two remaining options (i.e., lowband independent mode with the corresponding best highband mode, and lowband dependent (or harmonic) mode with the corresponding best highband mode), selection between these options is made with reference to a perceptual metric that covers both the lowband and the highband. In one example of such a multi-band case, the lowband independent mode uses GSVQ to encode a set of fixed subbands, and the highband independent mode uses a pulse coding scheme (e.g., factorial pulse coding) to encode the highband signal.

Figure 19:
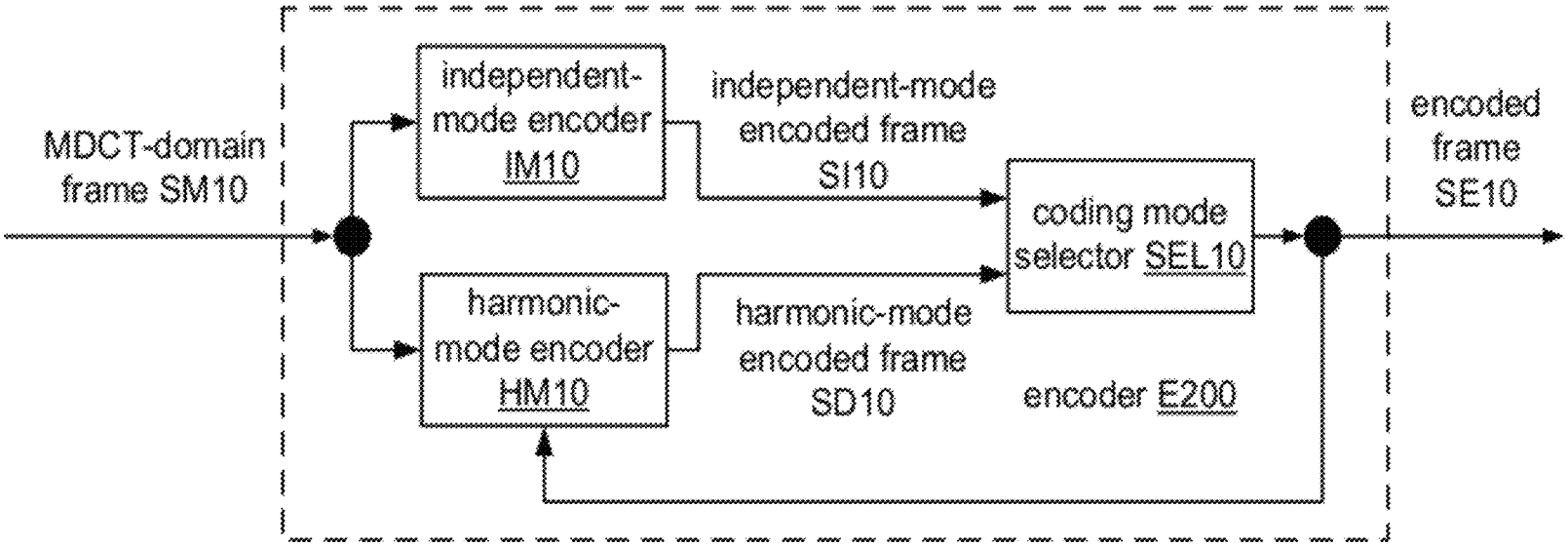
FIG. 19 shows a block diagram of an encoder E200.

FIG. 19 shows a block diagram of an encoder E200 according to a general configuration, which is configured to receive audio frames as samples in the MDCT domain (i.e., as transform domain coefficients). Encoder E200 includes an independent-mode encoder IM10 that is configured to encode a frame of an MDCT-domain signal SM10 according to an independent coding mode to produce an independent-mode encoded frame SI10. The independent coding mode groups the transform domain coefficients into subbands according to a predetermined (i.e., fixed) subband division and encodes the subbands using a vector quantization (VQ) scheme. Examples of coding schemes for the independent coding mode include pulse coding (e.g., factorial pulse coding and combinatorial pulse coding). Encoder E200 may also be configured according to the same principles to receive audio frames as samples in another transform domain, such as the fast Fourier transform (FFT) domain.

Encoder E200 also includes a harmonic-mode encoder HM10 (alternatively, a dependent-mode encoder) that is configured to encode the frame of MDCT-domain signal SM10 according to a harmonic model to produce a harmonic-mode encoded frame SD10. Either of both of encoders IM10 and HM10 may be implemented to include a corresponding instance of apparatus A100 such that the corresponding encoded frame is produced according to a dynamic allocation scheme as described herein. Encoder E200 also includes a coding mode selector SEL10 that is configured to use a distortion measure to select one among independent-mode encoded frame SI10 and harmonic-mode encoded frame SD10 as encoded frame SE10. Encoder E100 as shown in FIGS. 14A-14E may be realized as an implementation of encoder E200. Encoder E200 may also be used for encoding a lowband (e.g., 0-4 kHz) LPC residual in the MDCT domain and/or for encoding a highband (e.g., 3.5-7 kHz) LPC residual in the MDCT domain in a multi-band codec as shown in FIG. 17.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

An apparatus as disclosed herein (e.g., apparatus A100 and MF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100 and MF100) may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 or MD100, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., implementations of method M100 and other methods disclosed with reference to the operation of the various apparatus described herein) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

Listing A:

```
* Inputs:
 *    int B - number of bits to allocate
 *    double gains[m] - array of (squared) gains for each element
 *    int dims[m] - array of dimensions for each element
 *    int low_cap - minimum allocation for each non-pruned element
 *    int high_cap - maximum allocation for each element
 *    int m - number of elements
 *
 * Output:
 *    int b_o[ ] - length-m array of allocations
 {
   int zos[m]; /* array indicating which elements are in active allocation */
   int indies_prune[m]; /* array indicating which elements are pruned */
   double prune_thresh=316; /* elements with gain less than this
                                        threshold will be pruned ( 0 bits allocation ) */
   double factz, logz[m], deltab[m]; /* helper variables for allocation */
   /* Find max number of bands to prune from high-cap constraint */
   maxprunebands = m − ceil(B/high_cap);
   /* pre-compute all logarithms */
   for (i=0;i<m;i++) logz[i] = log2(gains[i]/dims[i]);
   /* preform pruning */
   if (average(gains)>100) { /* if average energy is non-trivial */
      for (i=0;i<m;i++) {
         if (gains[i]<prune_thresh) {
            indies_prune[i]=1; /* prune i-th element */
         }
      }
/* ensure that not too many elements are pruned */
      while (sum(indies_prune)>maxprunebands) {
                        /* find pruned element with targest gain */
                        k = argmax(gains[indies_prune==1]);
         indies_prune[k]=0; /* nn-prune largest-gain pruned element */
      }
   }
   /* initialize zos based on indies_prune */
   zos = 1-indies_prune;
   /* compute unconstrained allocation */
   dhatch=sum(dims[zos==1]);
   factz=sum((dims[zos==1]./dhatch).*logz[zos==1]);
   b_o[zos==1] = dims[zos==1]*(B/dhatch + 0.5*logz[zos==1] − 0.5*factz);
   b_o[zos==0] = 0;
   capcount_h = 0; /* records number of elements at high-cap */
   capcount_l = 0; /* records number of elements at low-cap */
   /* find max and min allocations */
   minny = min(b_o[zos==1]);
   maxxy = max(b_o[(zos==1]);
   /* cap allocation */
   while ((maxxy>high_cap)||(minny<low_cap)) {
      if ((maxxy > high_cap)&&(minny >= low_cap)) {
         /* over-allocations only - fix in chunk */
         for (i=0;i<m;i++) {
            if (b_o[i]>high_cap) {
               b_o[i] = high_cap;
               zos[i] = 0;
               capcount_h++;
            }
         }
      } else if ((maxxy <= high_cap)&&(minny < low_cap)) {
         /* under-allocations only - fix in chunk */
         for (i=0;i<m;i++) {
            if ((b_o[i]<low_cap)&&(zos[i]==1)) {
               b_o[i] = low_cap;
               zos[i] = 0;
               capcount_l++;
            }
         }
      } else if ((maxxy > high_cap)&&(minny < low_cap)) {
         /* both under- and over-allocations - fix biggest one */
         if ((maxxy-high_cap) > (low_cap-minny)) {
            /* fix worst overallocation */
            i_max = argmax(b_o[(zos==1]);
               b_o[i_max] = high_cap;
            zos[i_max] = 0;
            capcount_h++;
         } else {
            /* fix worst underallocation */
            i_min = argmin(b_o[zos==1);
                              b_o[i_min] = low_cap;
            zos[i_min] = 0;
            capcount_l++;
```

-continued

```
        }
      }
            /* compute unconstrained allocation on elements not pruned or
               capped, using bits not already assigned to capped elements */
      Bhat = B − high_cap*capcount_h − low_cap*capcount_l; /* remaining bits */
      dhatch=sum(dims[zos==1]);
      factz=sum((dims[zos==1]./dhatch).*logz[zos==1]);
            b_o[zos==1] = dims[zos==1]*(Bhat/dhatch + 0.5*logz[zos==1] − 0.5*factz);
      /* update max and min */
      minny = min(b_o[(zos==1]);
      maxxy = max(b_o[(zos==1]);
   }
   /* impose integer constraint */
   deltab = b_o − floor(b_o); /* Error in initial guess of integer allocation */
   b_o = floor(b_o); /* Initial guess of integer allocation */
   Bhat = sum(b_o); /* Bits used so far */
   Bbb = B − Bhat; /* Bits left to use */
   /* Set zos[i] to 1 if element i is not pruned or at high-cap, otherwise set to 0
      Record number of active elements in counter */
   for (i=0;i<m;i++) {
      if (indies_prune[i]==1)
         zos[i]=0;
      else if (b_o[i]<high_cap) {
         zos[i]=1;
         counter++;
      } else
         zos[i]=0;
   }
   /* While more bits are left than active elements, increment all active elements
Then recompute deltab, Bhat Bbb */
   while (Bbb>counter) {
      for (i=0;i<m;i++) {
         if (zos[i]==1) {
            b_o[i]++;
            if (b_o[i]>=high_cap) { /* Remove elements that reach high-cap */
               zos[i]=0;
               counter−−;
            }
            deltab[i]−−;
                  Bhat++;
         }
      }
      Bbb = B − Bhat;
   }
   /* Distribute any remaining bits according to precedence in deltab */
   for (j=0;j<Bbb;j++) {
      /* increment largest delta bin and remove from allocation */
            i_max = argmax(deltab[zos==1]);
            b_o[i_max]++;
            deltab[i_max]−−;
            zos[i_max]=0;
   }
   return;
}
```

```
Listing A:
* Inputs:
 *    int B - number of bits to allocate
 *    double gains[m] - array of (squared) gains for each element
 *    int dims[m] - array of dimensions for each element
 *    int low_cap - minimum allocation for each non-pruned VQ element
 *    int high_cap - maximum allocation for each VQ element
 *    int m - number of elements
 *
 * Output:
 *    int b_o[ ] - length-m array of allocations
 {
   int zos[m]; /* array indicating which elements are in active allocation */
   int indies_prune[m]; /* array indicating which elements are pruned */
   double prune_thresh=316; /* elements with gain less than this
                                    threshold will be pruned ( 0 bits allocation ) */
   double factz, logz[m], deltab[m]; /* helper variables for allocation */
   /* Find max number of bands to prune from high-cap constraint */
   maxprunebands = m − ceil (B/high_cap);
   /* pre-compute all logarithms */
   for (i=0;i<m;i++) logz[i] = log2(gains[i]/dims[i]);
```

-continued

```
/* perform pruning */
if (average(gains)>100 { /* if average energy is non-trivial */
   for (i=0;i<m;i++) {
      if (gains[i]<prune_thresh) {
         indies_prune[i]=1; /* prune i-th element */
      }
   }
/* ensure that not too many elements are pruned */
   while (sum(indies_prune)>maxprunebands) {
                  /* find pruned element with largest gain */
                  k = argmax(gains[indies_prune==1]);
      indies_prune[k]=0; /* nn-prune largest-gain pruned element */
   }
}
/* initialize zos based on indies_prune */
zos = 1−indies_prune;
/* compute unconstrained allocation */
dhatch=sum(dims[zos==1]);
factz=sum((dims[zos==1]./dhatch).*logz[zos==1]);
b_o[zos==1] = dims[zos==1]*(B/dhatch + 0.5*logz[zos==1] − 0.5*factz);
b_o[zos==0] = 0;
capcount_h = 0; /* records number of elements at high-cap */
capcount_l = 0; /* records number of elements at low-cap */
/* find max and min allocations for VQ elements*/
minny = min(b_o[(zos==1)&&(i<m−1)]);
maxxy = max(b_o[(zos==1)&&(i<m−1)]);
/* cap allocation */
while ((maxxy>high_cap)||(minny<low_cap)) {
   if ((maxxy > high_cap)&&(minny >= low_cap)) {
      /* over-allocation only - fix in chunk */
      for (i=0;i<m−1;i++) {
         if (b_o[i]>high_cap) {
            b_o[i] = high_cap;
            zos[i] = 0;
            capcount_h++;
         }
      }
   } else if ((maxxy <= high_cap)&&(minny < low_cap)) {
      /* under-allocations only - fix in chunk */
      for (i=0;i<m−1;i++) {
         if ((b_o[i]<low_cap)&&(zos[i]==1)) {
            b_o[i] = low_cap;
            zos[i] = 0;
            capcount_l++;
         }
      }
   } else if ((maxxy > high_cap)&&(minny < low_cap)) {
      /* both under- and over-allocation - fix biggest one */
      if ((maxxy-high_cap) > (low_cap-minny)) {
         /* fix worst overallocation */
         i_max = argmax(b_o[(zos==1)&&(i<m−1)]);
            b_o[i_max] = high_cap;
         zos[i_max] = 0;
         capcount_h++;
      } else {
         /* fix worst underallocation */
         i_min = argmin(b_o[zos==1)&&(i<m−1)];
                        b_o[i_min] = low_cap;
         zos[i_min] = 0;
         capcount_l++;
      }
   }
            /* compute unconstrained allocation on elements not pruned or
              capped, using bits not alreday assigned to capped elements */
   Bhat = B − high_cap*capcount_h − low_cap*capcount_l; /* remaining bits */
   dhatch=sum(dims[zos==1]);
   factz=sum((dims[zos==1]./dhatch).*logz[zos==1]);
            b_o[zos==1] = dims[zos==1]*(Bhat/dhatch + 0.5*logz[zos==1] − 0.5*factz);
   /* update max and min */
   minny = min(b_o[(zos==1)&&(i<m−1)]);
   maxxy = max(b_o[(zos==1)&&(i<m−1)]);
}
/* Impose integer constraint and fpc constraint */
b_o2 = floor(b_o); /* Initial guess of integer allocation */
/* Refine initial guess to match fpc constraint */
[p,fpcinc,B_fpc] = find_fpc_pulses(b_o2[m−1],fpc_length);
b_o2[m−1] = B_fpc;
Bhat = sum(b_o2); /* Bits used so far */
Bbb = B − Bhat; /* Bits left to use */
```

-continued

```
  /* bump up FPC, if possible */
  if (fpcinc <= Bbb) {
    b_o[m−1] += fpcinc;
    p++;
    Bbb −= fpcinc;
  }
  deltab = b_o − b_o2; /* Error in initial guess */
  b_o = b_o2; /* set b_o to initial guess */
  /* distribute remaining bits among VQ subbands, if possible */
  while (Bbb>0) {
    /* Find smallest allocation and its index */
    i_min = argmin(b_o[(i<(m−1))&&(zos==1)]);
    minny = b_o[i_min];
    if (minny>=high_cap) {
      /* all subbands at high_cap -> all remaining bits to fpc */
      [p,fpcinc,B_fpc] = find_fpc_pulses(b_o[m−1]+Bbb,fpc_length);
      b_o[m−1] = B_fpc;
      Bbb = 0;
    } else {
      /* distribute remaining bits by precedence in deltab */
      i_max = argmax(deltab[(zos==1)&&(b_o<high_cap)&&(i<m−1)]);
      b_o[i_max]++;
      Bbb−−;
      deltab[i_max]−−;
    }
  }
  return;
}
/*********************************************************************
 *
 * Finds the number of pulses to use no more than B bits on
 * fpc_length.
 * Inputs:
 *    B - desired bits allocation
 *    fpc_length - length of segment to code
 *
 * Output:
 *    m - number of pulses
 *    fpcinc - number of bits that 1 additional pulse will incur
 *    B_fin - number of bits allocated
 *
 * Relies on helper function B_fin = FPC_req(m,fpc_length), which
 * takes as inputs the number pulses and input length for FPC
 * encoding, and returns the number of bits that FPC indexing will
 * require. This can be a simple look-up table, or an on-the-fly
 * calculation using the FPC indexing functions.
*********************************************************************/
[m,fpcinc,B_fin] = find_fpc_pulses(B,fpc_length)
{
  /* Compute initial guess */
  m = floor(B/(1+log2(fpc_length)));
  B_fin = FPC_req(m,fpc_length);
  fpcinc = FPC_req(m+1,fpc_length)−B_fin;
  /* adjust guess until as close to desired allocation as possible
     without exceeding it */
  while ((B_fin>B)||((B_fin+MAX(1,fpcinc)<=B)) {
    if ((B−B_fin>5)||(B−B_fin<0)) {
      /* if current allocation is too large, or too small by
         more than 5 bits, use linear model to adjust guess */
      m = floor(m + (B−B_fin)/MAX(1,fpcinc));
    } else {
      /* if current allocation is too small by less than 5 bits,
         increment by one pulse */
      m++;
    }
    B_fin = FPC_req(m,fpc_length);
    fpcinc = FPC_req(m+1,fpc_length)−B_fin;
  }
  return(m,fpcinc,B_fin);
}
```

What is claimed is:

1. A method of dynamic bit allocation for encoding audio signals, said method comprising:

for each among a plurality of vectors, calculating a corresponding one of a plurality of gain factors;

for each among the plurality of vectors, calculating, by an audio encoding electronic apparatus, a corresponding bit allocation that is based on a corresponding gain factor;

for at least one vector among the plurality of vectors, determining that a corresponding bit allocation is not greater than a corresponding minimum allocation value, wherein each corresponding minimum allocation value is calculated based on a corresponding vector length and based on a value, wherein the value is the same for each of said at least one vector;

in response to said determining, for each of said at least one vector, changing, by the audio encoding electronic apparatus, a corresponding bit allocation; and encoding each vector of the plurality of vectors into a corresponding allocated number of bits.

2. The method of dynamic bit allocation according to claim 1, wherein a first minimum allocation value corresponding to a first vector among the plurality of vectors is different from a second minimum allocation value corresponding to a second vector among the plurality of vectors.

3. The method of dynamic bit allocation according to claim 1, wherein each corresponding minimum allocation value is calculated as a minimum of a corresponding vector length and the value.

4. The method of dynamic bit allocation according to claim 1, wherein each corresponding minimum allocation value is calculated according to a monotonically nondecreasing function of a corresponding vector length.

5. The method of dynamic bit allocation according to claim 1, wherein said method comprises, for each among the plurality of vectors, calculating a value of a corresponding vector's energy distribution, and wherein, for each among the plurality of vectors, a corresponding bit allocation is based on a corresponding value of a corresponding vector's energy distribution.

6. The method of dynamic bit allocation according to claim 1, wherein said method comprises, for at least one among the plurality of vectors:

determining that a corresponding bit allocation does not correspond to a valid codebook index length, and reducing a corresponding bit allocation in response to said determining.

7. The method of dynamic bit allocation according to claim 1, wherein, for at least one among the plurality of vectors, a corresponding bit allocation is an index length of a codebook of patterns that each have n unit pulses, and said method comprises calculating a number of bits between a corresponding bit allocation and an index length of a codebook of patterns that each have (n+1) unit pulses.

8. The method of dynamic bit allocation according to claim 1, wherein said method comprises calculating, from each among the plurality of vectors, a corresponding gain factor and a corresponding shape vector.

9. The method of dynamic bit allocation according to claim 1, wherein said method comprises determining a length of each of the plurality of vectors, wherein said determining a length of each of the plurality of vectors is based on locations of a second plurality of vectors, and wherein a frame of an audio signal includes the plurality of vectors and the second plurality of vectors.

10. The method of dynamic bit allocation according to claim 1, wherein the plurality of gain factors are calculated by dequantizing a corresponding quantized gain vector.

11. An apparatus for dynamic bit allocation for encoding audio signals, said apparatus comprising:

means for calculating, for each among a plurality of vectors, a corresponding one of a plurality of gain factors;

means for calculating, for each among the plurality of vectors, a corresponding bit allocation that is based on a corresponding gain factor;

means for determining, for at least one vector among the plurality of vectors, that a corresponding bit allocation is not greater than a corresponding minimum allocation value, wherein each corresponding minimum allocation value is calculated based on a corresponding vector length and based on a value, wherein the value is the same for each of said at least one vector;

means for changing a corresponding bit allocation, in response to said determining, for each of said at least one vector; and means for encoding each vector of the plurality of vectors into a corresponding allocated number of bits.

12. The apparatus for dynamic bit allocation according to claim 11, wherein a first minimum allocation value corresponding to a first vector among the plurality of vectors is different from a second minimum allocation value corresponding to a second vector among the plurality of vectors.

13. The apparatus for dynamic bit allocation according to claim 11, wherein each corresponding minimum allocation value is calculated as a minimum of a corresponding vector length and the value.

14. The apparatus for dynamic bit allocation according to claim 11, wherein each corresponding minimum allocation value is calculated according to a monotonically nondecreasing function of a corresponding vector length.

15. The apparatus for dynamic bit allocation according to claim 11, wherein said apparatus includes means for calculating, for each among the plurality of vectors, a value of a corresponding vector's energy distribution, and wherein, for each among the plurality of vectors, a corresponding bit allocation is based on a corresponding value of a corresponding vector's energy distribution.

16. The apparatus for dynamic bit allocation according to claim 11, wherein said apparatus comprises means for determining, for at least one among the plurality of vectors, that a corresponding bit allocation does not correspond to a valid codebook index length, and for reducing a corresponding bit allocation in response to said determining.

17. The apparatus for dynamic bit allocation according to claim 11, wherein, for at least one among the plurality of vectors, a corresponding bit allocation is an index length of a codebook of patterns that each have n unit pulses, and said apparatus comprises means for calculating a number of bits between a corresponding bit allocation and an index length of a codebook of patterns that each have (n+1) unit pulses.

18. The apparatus for dynamic bit allocation according to claim 11, wherein said apparatus comprises means for calculating, from each among the plurality of vectors, a corresponding gain factor and a corresponding shape vector.

19. The apparatus for dynamic bit allocation according to claim 11, wherein said apparatus comprises means for determining a length of each of the plurality of vectors, wherein said determining a length of each of the plurality of vectors is based on locations of a second plurality of vectors, and wherein a frame of an audio signal includes the plurality of vectors and the second plurality of vectors.

20. The apparatus for dynamic bit allocation according to claim 11, wherein the plurality of gain factors are calculated by means for dequantizing a corresponding quantized gain vector.

21. An apparatus for dynamic bit allocation for encoding audio signals, said apparatus comprising:

a processor;

a gain factor calculator configured to calculate, for each among a plurality of vectors, a corresponding one of a plurality of gain factors;

a bit allocation calculator configured to calculate, for each among the plurality of vectors, a corresponding bit allocation that is based on a corresponding gain factor;

a comparator configured to determine, for at least one vector among the plurality of vectors, that a corresponding bit allocation is not greater than a corresponding minimum allocation value, wherein each corresponding minimum allocation value is calculated based on a corresponding vector length and based on a value, wherein the value is the same for each of said at least one vector;

an allocation adjustment module configured to change a corresponding bit allocation, in response to said determining, for each of said at least one vector; and an encoder configured to encode each vector of the plurality of vectors into a corresponding allocated number of bits.

22. The apparatus for dynamic bit allocation according to claim 21, wherein a first minimum allocation value corresponding to a first vector among the plurality of vectors is different from a second minimum allocation value corresponding to a second vector among the plurality of vectors.

23. The apparatus for dynamic bit allocation according to claim 21, wherein each corresponding minimum allocation value is calculated as a minimum of a corresponding vector length and the value.

24. The apparatus for dynamic bit allocation according to claim 21, wherein the corresponding minimum allocation value is calculated according to a monotonically nondecreasing function of a corresponding vector length.

25. The apparatus for dynamic bit allocation according to claim 21, wherein said method comprises a sparsity factor calculator configured to calculate, for each among the plurality of vectors, a value of a corresponding vector's energy distribution, and wherein, for each among the plurality of vectors, a corresponding bit allocation is based on a corresponding value of a corresponding vector's energy distribution.

26. The apparatus for dynamic bit allocation according to claim 21, wherein said apparatus comprises a verification module configured to determine, for at least one among the plurality of vectors, that a corresponding bit allocation does not correspond to a valid codebook index length and to reduce a corresponding bit allocation in response to said determining.

27. The apparatus for dynamic bit allocation according to claim 21, wherein, for at least one among the plurality of vectors, a corresponding bit allocation is an index length of a codebook of patterns that each have n unit pulses, and said apparatus comprises a module configured to calculate a number of bits between a corresponding bit allocation and an index length of a codebook of patterns that each have (n+1) unit pulses.

28. The apparatus for dynamic bit allocation according to claim 21, wherein said apparatus comprises a normalizer configured to calculate, from each among the plurality of vectors, a corresponding gain factor and a corresponding shape vector.

29. The apparatus for dynamic bit allocation according to claim 21, wherein said apparatus comprises a frame divider configured to determine a length of each of the plurality of vectors, wherein said determining a length of each of the plurality of vectors is based on locations of a second plurality of vectors, and wherein a frame of an audio signal includes the plurality of vectors and the second plurality of vectors.

30. The apparatus for dynamic bit allocation according to claim 21, wherein the plurality of gain factors are calculated by dequantizing a corresponding quantized gain vector.

31. A non-transitory computer-readable storage medium having tangible features that cause an apparatus reading the features to:

calculate, for each among a plurality of vectors, a corresponding one of a plurality of gain factors;

calculate, for each among the plurality of vectors, a corresponding bit allocation that is based on a corresponding gain factor;

determine, for at least one vector among the plurality of vectors, that a corresponding bit allocation is not greater than a corresponding minimum allocation value, wherein each corresponding minimum allocation value is calculated based on a corresponding vector length and based on a value, wherein the value is the same for each of said at least one vector;

change a corresponding bit allocation, in response to said determining, for each of said at least one vector; and encode each vector of the plurality of vectors into a corresponding allocated number of bits.

* * * * *